US009752760B2

(12) United States Patent
Chang et al.

(10) Patent No.: US 9,752,760 B2
(45) Date of Patent: Sep. 5, 2017

(54) LIGHTING DEVICE

(71) Applicant: LG Electronics Inc., Seoul (KR)

(72) Inventors: Hyeuk Chang, Seoul (KR); Jongpil Kim, Seoul (KR); Jaepyo Hong, Seoul (KR); Jinsung Kwak, Seoul (KR)

(73) Assignee: LG Electronics Inc., Seoul (KR)

( * ) Notice: Subject to any disclaimer, the term of this patent is extended or adjusted under 35 U.S.C. 154(b) by 17 days.

(21) Appl. No.: 14/922,947

(22) Filed: Oct. 26, 2015

(65) Prior Publication Data

US 2016/0116148 A1 Apr. 28, 2016

(30) Foreign Application Priority Data

Oct. 27, 2014 (KR) ..... 10-2014-0146380
Oct. 27, 2014 (KR) ..... 10-2014-0146382
Oct. 27, 2014 (KR) ..... 10-2014-0146385
Oct. 27, 2014 (KR) ..... 10-2014-0146386

(51) Int. Cl.

| | |
|---|---|
| ***F21V 17/16*** | (2006.01) |
| ***F21V 5/00*** | (2015.01) |
| ***F21V 17/12*** | (2006.01) |
| ***F21V 23/00*** | (2015.01) |
| ***F21V 23/06*** | (2006.01) |
| ***F21K 9/20*** | (2016.01) |
| *F21V 31/00* | (2006.01) |
| *F21W 131/10* | (2006.01) |
| *F21Y 105/10* | (2016.01) |
| *F21Y 115/10* | (2016.01) |

(52) U.S. Cl.

CPC ..... *F21V 17/164* (2013.01); *F21K 9/20* (2016.08); *F21V 5/007* (2013.01); *F21V 17/12* (2013.01); *F21V 23/002* (2013.01); *F21V 23/008* (2013.01); *F21V 23/06* (2013.01); *F21V 31/005* (2013.01); *F21W 2131/10* (2013.01); *F21Y 2105/10* (2016.08); *F21Y 2115/10* (2016.08)

(58) Field of Classification Search

CPC ..... F21V 17/164; F21V 5/007; F21V 17/12; F21V 23/002; F21V 23/008; F21V 23/06; F21V 31/005; F21K 9/20; F21Y 2105/10; F21Y 2115/10; F21Y 2101/00; F21W 2131/10

USPC ..... 362/97.1

See application file for complete search history.

(56) References Cited

U.S. PATENT DOCUMENTS

2014/0268821 A1 9/2014 Boyer et al.

FOREIGN PATENT DOCUMENTS

| | | | |
|---|---|---|---|
| CN | 201711233 | U | 1/2011 |
| CN | 201764297 | U | 3/2011 |
| CN | 203240335 | U | 10/2013 |
| CN | 203893014 | U | 10/2014 |
| DE | 102013008067 | * | 11/2014 |

(Continued)

*Primary Examiner* — Laura Tso

(74) *Attorney, Agent, or Firm* — Birch, Stewart, Kolasch & Birch, LLP

(57) ABSTRACT

A lighting device includes a housing including a power connection hole, at least one light source module disposed on a lower surface of the housing, and a front cover coupled to the housing to define a space in which the light source module is located. The front cover transmits light generated by the light source module. The light source module includes a support protrusion supported by the front cover. The front cover presses the support protrusion when the front cover is coupled to the housing.

18 Claims, 25 Drawing Sheets

(56) References Cited

FOREIGN PATENT DOCUMENTS

| | | | |
|---|---|---|---|
| EP | 2 306 068 | A1 | 4/2011 |
| JP | 2013-65411 | A | 4/2013 |
| JP | 2013-182777 | A | 9/2013 |
| KR | 10-2012-0036393 | A | 4/2012 |
| KR | 10-1240328 | B1 | 3/2013 |
| KR | 10-1308394 | B1 | 9/2013 |
| KR | 30-0752960 | S | 7/2014 |
| WO | WO 2010/035996 | A2 | 4/2010 |
| WO | WO 2012/030112 | A1 | 3/2012 |
| WO | WO 2013/065146 | A1 | 5/2013 |

* cited by examiner

LIGHTING DEVICE

CROSS-REFERENCE TO RELATED APPLICATION

This application claims the priority benefit of Korean Patent Application Nos. 10-2014-0146380, 10-2014-0146382, 10-2014-0146385 and 10-2014-0146386, all filed on Oct. 27, 2014, in the Korean Intellectual Property Office, the entire disclosures of all of which are hereby incorporated by reference herein.

BACKGROUND OF THE INVENTION

1. Field of the Invention

Exemplary embodiments of the present invention relate to a lighting device.

2. Description of the Related Art

In general, light bulbs or fluorescent lamps are commonly used as indoor or outdoor lighting. However, these light bulbs or fluorescent lamps have a short life and thus have to be frequently replaced. In addition, a phenomenon in which the illuminance of the conventional fluorescent lamps is gradually lowered due to degradation caused over time may excessively occur.

In order to address these problems, various lighting modules employing LEDs (Light Emitting Diodes) capable of realizing improved control characteristics, a fast response speed, high electrophotic conversion efficiency, a long life, low power consumption, and high luminance and emotional lighting characteristics, have been developed.

LEDs are a type of semiconductor device for converting electric energy into light. The LEDs have advantages of low power consumption, a semi-permanent life, a rapid response speed, safety, and environment friendliness, compared to existing light sources such as fluorescent lamps and incandescent lamps. For this reason, much research for substituting the existing light sources with the LEDs is ongoing. The LEDs are now increasingly used as light sources for various lighting devices such as liquid crystal display devices, electric sign boards, and street lamps used in the interior and exterior.

However, a lighting device using light emitting elements has a structure in which wiring is complicated and exposed to the outside since a power unit is located at an upper portion of a housing or at a side of the lighting device, and thus wiring work is difficult and exposed to electric danger.

In addition, when a plurality of light source modules is used in the lighting device, it is difficult to wire the light source modules.

Furthermore, when the light source modules are connected to each other, it is difficult to address waterproof problems together with the wiring.

When the power unit is spaced apart from the housing, there are problems of coupling, electric wiring, and waterproofing therebetween.

Since the light emitting elements are easily damaged by heat in the lighting device using the same, research for efficiently dissipating heat generated by the light emitting elements is ongoing.

SUMMARY OF THE INVENTION

Therefore, the present invention has been made in view of the above problems, and it is an object of the present invention to provide a lighting device in which a power unit spaced apart from a housing is easily electrically connected to a light source module and sealing therebetween is easily performed.

In accordance with an aspect of the present invention, the above and other objects can be accomplished by the provision of a lighting device including a housing including a power connection hole, at least one light source module disposed on a lower surface of the housing, and a front cover coupled to the housing to define a space in which the light source module is located, the front cover transmitting light generated by the light source module, wherein the light source module includes a support protrusion supported by the front cover, and the front cover presses the support protrusion when the front cover is coupled to the housing.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
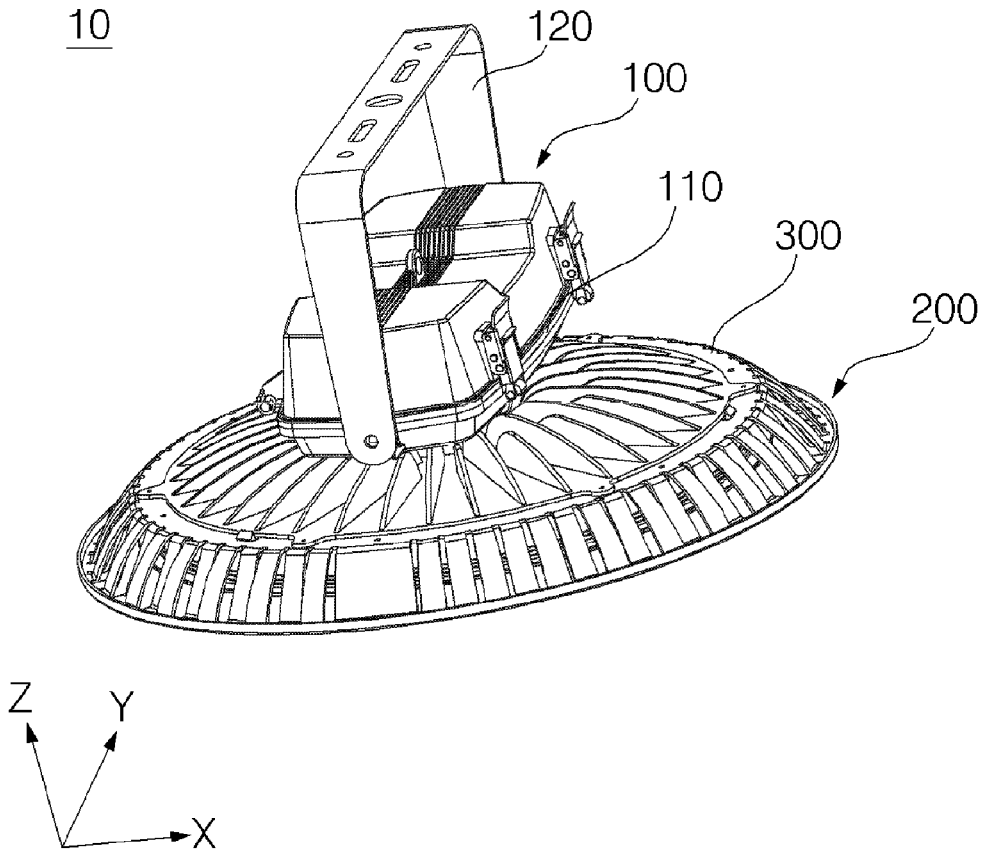
FIG. 1 is a perspective view illustrating a lighting device according to an embodiment of the present invention.
Figure 2:
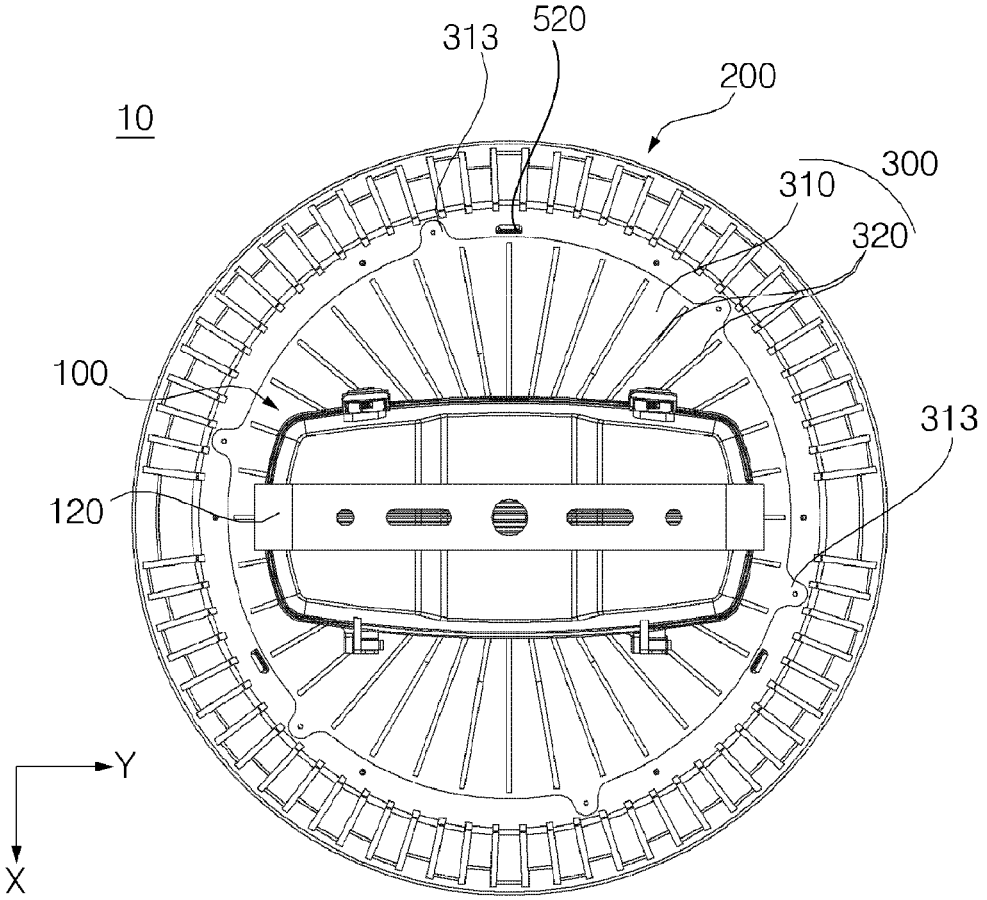
FIG. 2 is a top view illustrating the lighting device according to the embodiment of the present invention.
Figure 3:
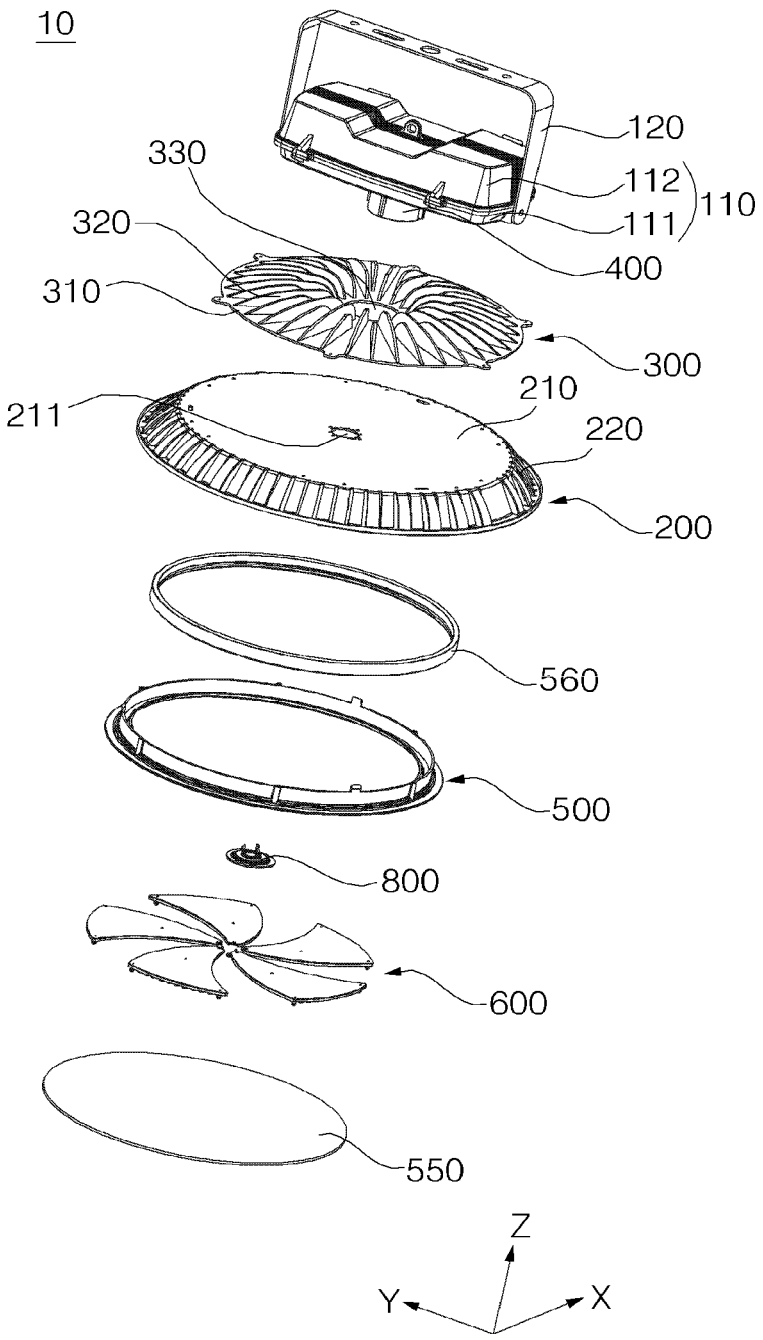
FIG. 3 is an exploded perspective view illustrating the lighting device of FIG. 1.

FIG. 1 is a perspective view illustrating a lighting device according to an embodiment of the present invention. FIG. 2 is a top view illustrating the lighting device according to the embodiment of the present invention. FIG. 3 is an exploded perspective view illustrating the lighting device of FIG. 1.

Referring to FIGS. 1 to 3, a lighting device 10 according to an embodiment includes a power unit 100, a housing 200 having a power connection hole 211, at least one light source module 600 disposed on a lower surface of the housing 200, a power unit 100 spaced apart from an upper portion of the housing 200 so as to supply power to the light source module 600, a connection unit 400 connecting the housing 200 to the power unit 100, and a light source fixing unit for fixing the light source module 600 to the connection unit 400.

In addition, a lighting device 10 according to another embodiment includes a housing 200 having a power connection hole 211, at least one light source module 600 disposed on a front surface of the housing 200, and a front cover 500 coupled to the housing 200 to define a space in which the light source module 600 is located and transmitting light generated by the light source module 600.

The power unit 100 supplies power to the light source module 600.

Specifically, the power unit 100 controls an overall operation of the lighting device and supplies actuating power to the light source module 600.

For example, the power unit 100 may include a power section 113 (see FIG. 5B) which generates actuating power and generates and outputs control signals, and a casing 110 accommodating the power section 113.

The power section 113 generates actuating power supplied to the light source module 600 and control signals. The power section 113 may include a main substrate and a plurality of components. The main substrate may be a printed circuit board. The components are mounted on and electrically connected to the main substrate.

In addition, the power section 113 may be a PSU (Power Supply Unit). In this case, the power section 113 may control the light source module 600 according to wireless control signals received from a communication module.

The casing 110 accommodates the power section 113. Specifically, the casing 110 has a space defined by coupling of a lower casing 111 and an upper casing 112 and the power section 113 is accommodated in the space.

In particular, a sealing member (not shown) is located at a contact edge between the lower casing 111 and the upper casing 112 for waterproofing therebetween.

A support member 120 for fixing the casing 110 to an outside space is provided on an outer surface of the casing 110.

Specifically, the support member 120 has a laterally elongated rectangular plate shape having a certain thickness, and both ends of the support member 120 are rotatably fixed to the outer surface of the casing 110.

The power unit 100 is spaced apart from the housing 200. This enables the light source module 600 to be prevented from overheating due to transfer of heat generated by the power unit 100 to the light source module 600.

Specifically, the power unit 100 is arranged on an upper portion of the housing 200 to be spaced apart from the housing 200.

Here, the upward direction refers to a Z-axis direction and the downward direction refers to a direction opposite to the Z-axis direction. In addition, the lateral direction refers to an X- or Y-axis direction perpendicular to the Z-axis direction.

In this case, the housing 200 and the power unit 100 are spaced apart from each other by the connection unit 400. The connection unit 400 suppresses heat transfer by fixing the housing 200 and the power unit 100 and spacing them from each other.

In particular, the connection unit 400 may have a smaller size than the housing 200 and the casing 110 of the power unit 100.

Hereinafter, the connection unit will be described in detail with reference to the drawings.

Figure 4:
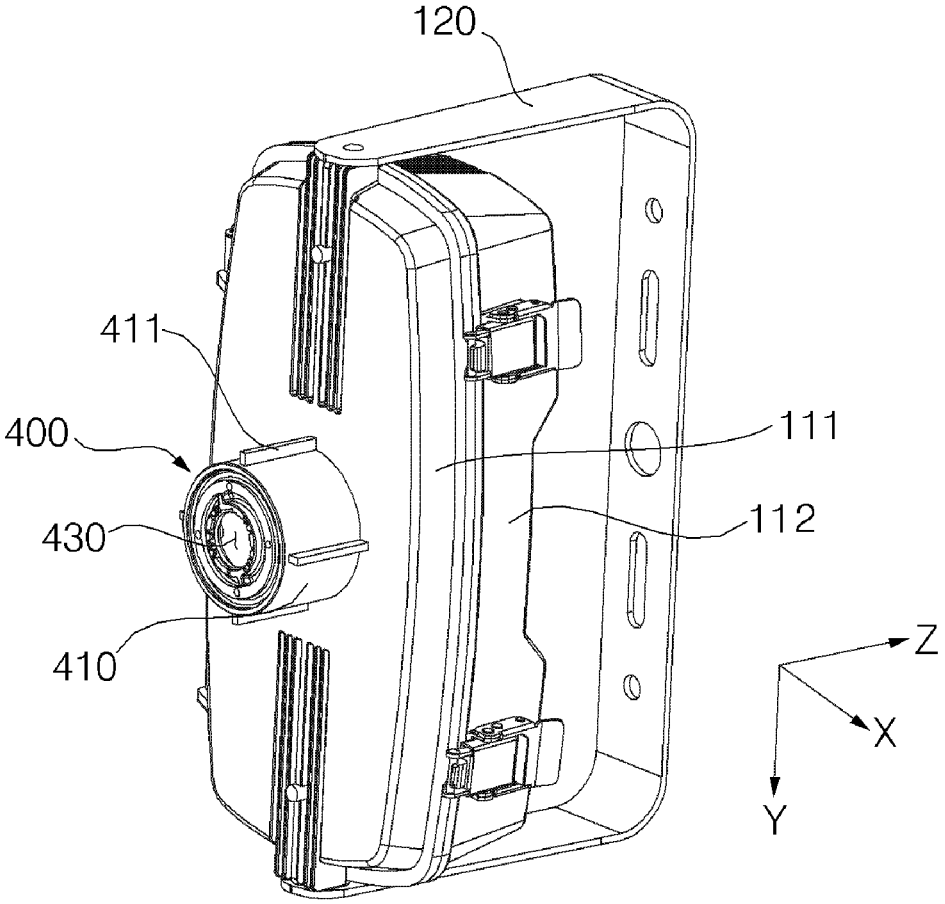
FIG. 4 is a perspective view illustrating a power unit and a connection unit according to the embodiment of the present invention.
Figure 5A:
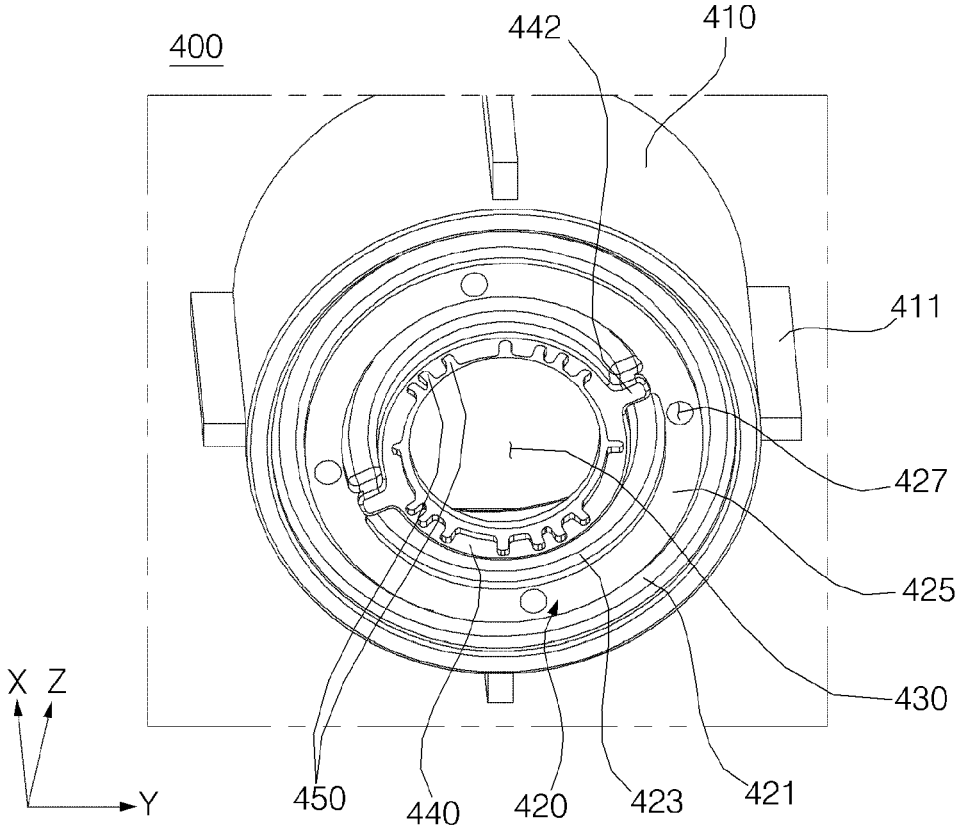
FIG. 5A is an enlarged perspective view illustrating the connection unit according to the embodiment of the present invention.
Figure 5B:
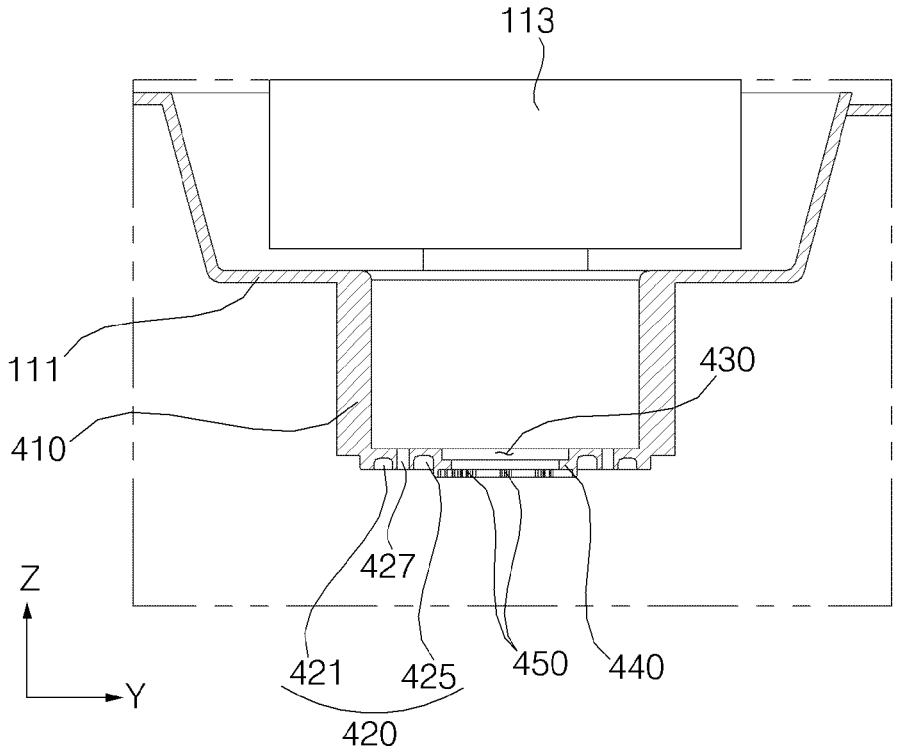
FIG. 5B is a cross-sectional view illustrating a lower casing and the connection unit according to the embodiment of the present invention.

FIG. 4 is a perspective view illustrating the power unit and the connection unit according to the embodiment of the present invention. FIG. 5A is an enlarged perspective view illustrating the connection unit according to the embodiment of the present invention. FIG. 5B is a cross-sectional view illustrating the lower casing and the connection unit according to the embodiment of the present invention.

Referring to FIGS. 4-5B, the connection unit 400 transfers power of the power unit 100 to the light source module 600 and allows the power unit 100 to be spaced apart from the housing 200.

For example, the connection unit 400 has a cylindrical shape having a cable hole 430 through which a cable (not shown) passes therein.

Specifically, the connection unit 400 includes a cable hole 430 through which a cable (not shown) passes therein and a connection body 410 surrounding the cable hole 430.

The connection body 410 has the cable accommodated in the cable hole 430.

The connection unit 400 may be formed integrally with the casing 110. Specifically, the cable hole 430 of the connection body 410 of the connection unit 400 communicates with an inner portion of the casing 110. That is, the connection unit 400 has a structure in which an opening of the lower casing 111 communicates with the cable hole 430.

The connection unit 400 and the casing 110 are integrally formed and are coupled to the upper portion of the housing 200, thereby being easily replaced and repaired in case of failure.

The cable connected to the power section 113 located inside the casing 110 extends to the cable hole 430 through the opening of the lower casing 111.

The connection body 410 connects the housing 200 to the power unit 100. A portion of the connection body 410 is inserted into the power connection hole 211.

The connection body 410 may have reinforcement ribs 411 formed in a longitudinal direction of the connection body 410 on an outer surface thereof. The reinforcement ribs 411 enhance stiffness and elastic restoring force of the connection body 410.

Specifically, the connection body 410 includes an insertion section 440 inserted into the power connection hole 211 and a coupling section 420 coupled around the power connection hole 211.

The insertion section 440 is defined as a region adjacent to the cable hole 430 in the connection body 410 forming an edge of the cable hole 430, and the coupling section 420 is defined as a region adjacent to an outer surface of the insertion section 440 in the connection body 410 forming the edge of the cable hole 430.

In particular, referring to FIGS. 5A-5B, the insertion section 440 surrounds the cable hole 430.

The insertion section 440 is inserted into the power connection hole 211 and is exposed thereto.

The insertion section 440 has a shape corresponding to that of the power connection hole 211. For example, the power connection hole 211 may have a circular shape (in the X-Y axis plane) and the insertion section 440 may also have a circular shape.

The insertion section 440 is formed so as to protrude further than the coupling section 420, and thus may efficiently prevent introduction of water from the outside.

In addition, it is preferable that the insertion section 440 is formed so as to protrude further than a lower surface of the coupling section 420, and a step therebetween corresponds to the thickness of the housing 200.

In addition, the insertion section 440 has alignment protrusions 442 matched with alignment grooves 212 (see FIG. 6) formed on the power connection hole 211.

The alignment protrusions 442 determine positions of the insertion section 440 and the power connection hole 211 at the time of temporary assembly.

Specifically, the alignment protrusions 442 protrude from the outer surface of the insertion section 440.

A light source fixing groove 450 of the light source fixing unit is formed on an inner surface of the insertion section 440.

That is, the light source fixing unit fixes the light source module 600 to the connection unit 400. The light source fixing unit includes a light source fixing groove 450 and a light source fixing protrusion 635 (see FIG. 10B) matched with the light source fixing groove 450.

Here, the light source fixing groove 450 is formed in such a manner that an inner surface forming the cable hole 430 in the connection body 410 is recessed outward.

That is, the light source fixing groove 450 is formed in such a manner that the inner surface of the insertion section 440 is recessed outward in the X-Y axis plane.

It is preferable that the light source fixing groove 450 is tightly fitted to the light source fixing protrusion 635 to be described later.

The light source fixing groove 450 fixes the light source module 600 and determines a position of the light source module 600.

Since the light source fixing groove 450 is formed in such a manner that the inner surface of the insertion section 440 is recessed outward and thus the light source module 600 is easily fixed to the insertion section 440, water introduced from the outside may be blocked by the coupling section 420.

That is, when protrusions or holes are formed on the housing 200 made of a plate material, a water leak is caused through them. Therefore, instead, the cable hole 430 of the connection unit 400 coupled to the preformed power connection hole 211 is utilized, thereby improving waterproof performance and increasing space efficiency.

The light source fixing groove 450 may include a plurality of light source fixing grooves circumferentially arranged on the inner surface of the cable hole 430.

The light source fixing grooves 450 provide spaces for coupling of a plurality of light source modules 600.

Since one light source module 600 has one light source fixing protrusion 635, one light source module 600 is coupled to one light source fixing groove 450.

Accordingly, power consumption of the lighting device 10 may be determined according to the number of coupled light source modules 600 having a single standard.

For example, in a case in which one light source module 600 uses up 30 watts, the light device 10 uses up 90 watts when three light source modules are utilized, and the lighting device 10 uses up 120 watts when four light source modules are utilized.

Accordingly, the light source modules 600 may be simply combined according to power consumption in the lighting device.

In more detail, two to four light source fixing grooves 450 form one group, and a plurality of groups may be symmetrically located around the cable hole 430.

Accordingly, the power consumption of the lighting device 10 may be adjusted according to the number of coupled light source modules. In addition, since the light source modules 600 are symmetrically arranged about the cable hole 430 in the grouped light source fixing grooves 450, uniform light may be radiated regardless of the number of light source modules 600.

The coupling section 420 is coupled to the housing 200 while surrounding the power connection hole 211.

For example, the coupling section 420 overlaps with the periphery of the power connection hole 211 to come into contact with the upper surface of the housing 200.

The coupling section 420 defines a space in which a housing fastening member 810 (see FIG. 8C) is penetrated and coupled, and a space in which a sealing member is located.

Thus, the coupling section 420 is coupled to the housing 200, and prevents water from infiltrating into the power connection hole 211 formed in the housing 200.

In particular, the coupling section 420 has a step with the insertion section 440, thereby efficiently preventing water from infiltrating into the power connection hole 211.

The coupling section 420 surrounds the insertion section 440.

In addition, the coupling section 420 of the connection body 410 has an outer sealing groove 421 and a body coupling hole 427.

The body coupling hole 427 provides a place in which the housing fastening member 810 such as a bolt is coupled.

The body coupling hole 427 is formed on the coupling section 420 and the housing fastening member 810, passing through the housing 200 is inserted and coupled to the body coupling hole 427.

Specifically, the body coupling hole 427 is located so as to correspond to a housing coupling hole 213 (see FIG. 8C) formed in the housing 200.

The body coupling hole 427 includes a plurality of body coupling holes 427 formed in a circumferential direction of the coupling section 420 so as to surround the insertion section 440.

Each of the body coupling holes 427 is recessed upward from a lower surface of the coupling section 420.

Since the housing fastening member 810 passing through the housing coupling hole 213 is fastened to the body coupling hole 427, water may be introduced from the outside through the housing coupling hole 213 and/or the body coupling hole 427.

Accordingly, the embodiment may further include a sealing member for water sealing between the coupling section 420 and the housing 200.

The sealing member is located between the coupling section 420 and a rear surface of the housing 200 and comes into close contact with the coupling section 420 and the rear surface of the housing 200. Specifically, the sealing member is located between the coupling section 420 and a rear surface of a base plate 210 (see FIG. 3) forming the periphery of the power connection hole 211.

For example, the sealing member is arranged to surround the insertion section 440 and the body coupling holes 427. Specifically, the sealing member has a ring shape and is arranged to surround the insertion section 440 and the body coupling holes 427 on the plane parallel with the base plate 210.

Figure 8A:
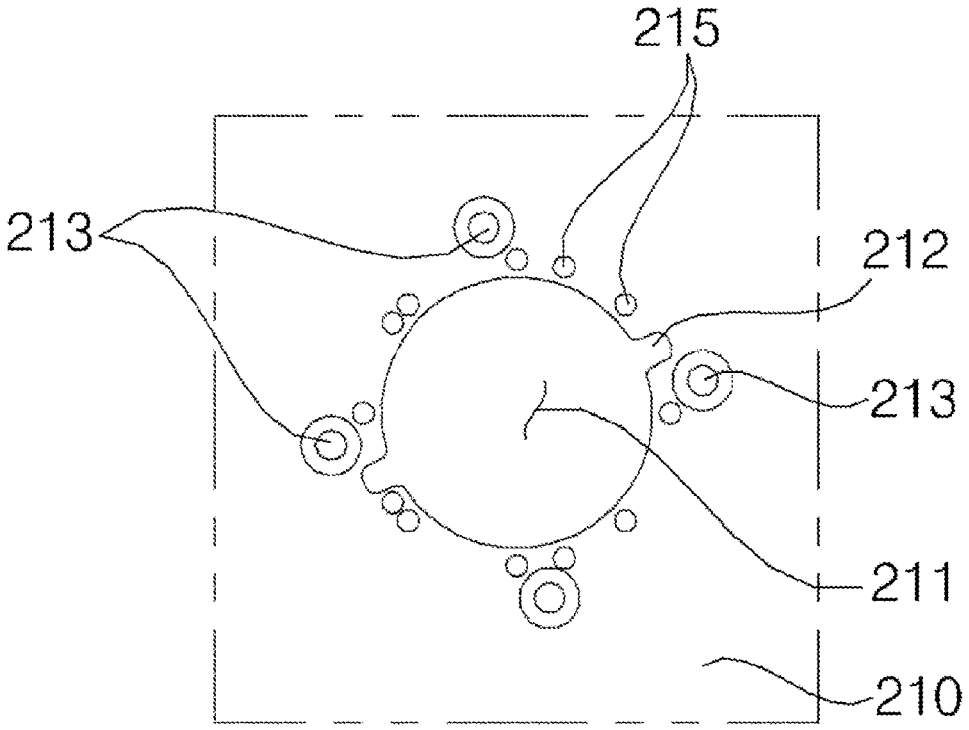
FIG. 8A is a top view illustrating a power connection hole formed in the housing according to the embodiment of the present invention.
Figure 8B:
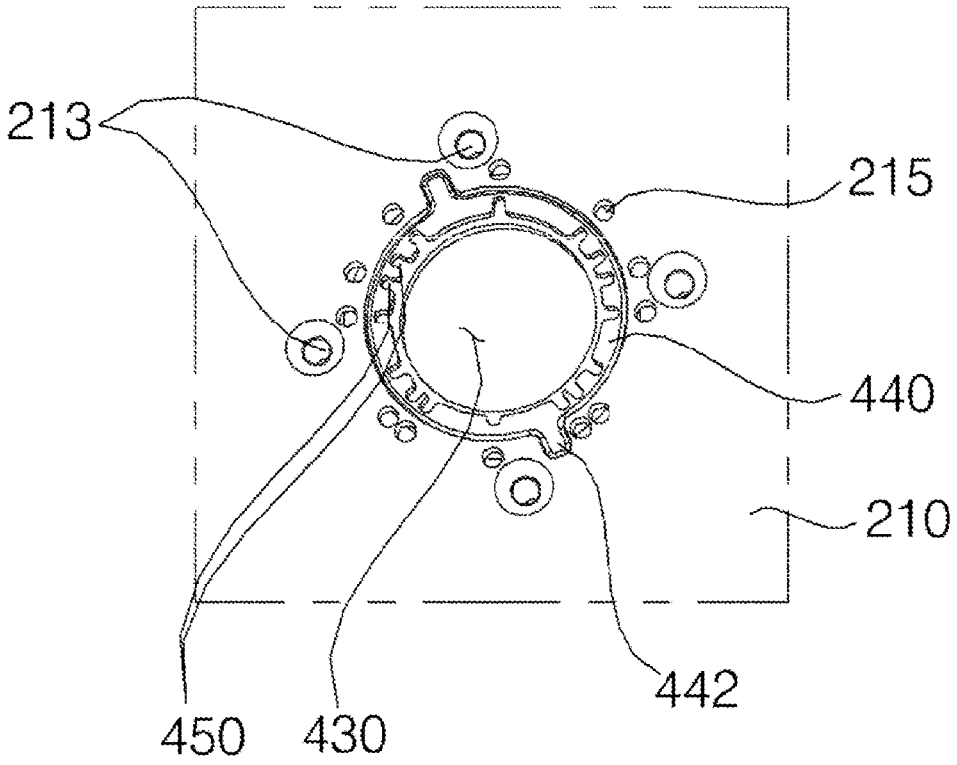
FIG. 8B is a top view illustrating a state in which an insertion section of the connection unit is inserted into the power connection hole according to the embodiment of the present invention.
Figure 8C:
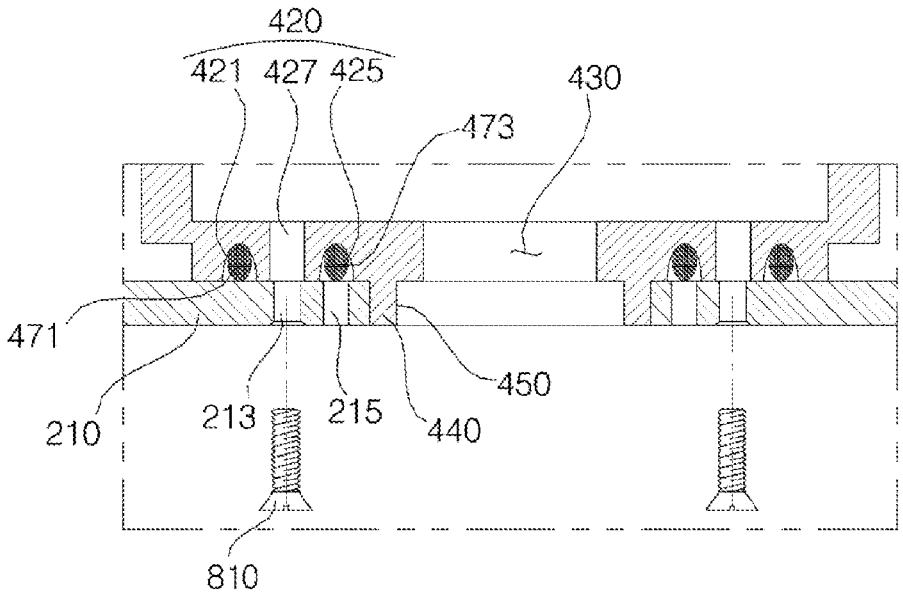
FIG. 8C is a cross-sectional view illustrating a state in which the insertion section of the connection unit is inserted into the power connection hole according to the embodiment of the present invention.

For another example, referring to FIG. 8C, a sealing member includes an inner sealing member 473 arranged to surround the insertion section 440, and an outer sealing member 471 arranged to surround the insertion section 440, the inner sealing member 473, and the body coupling holes 427. The body coupling holes 427 are located outside a closed space on the plane surrounded by the inner sealing member 473.

Specifically, the outer sealing member 471 is arranged to surround the power connection hole 211, the insertion section 440, and the body coupling holes 427.

In more detail, the outer sealing member 471 defines a closed space (on the plane) therein, and is arranged in the circumferential direction of the coupling section 420. That is, the outer sealing member 471 has a ring shape.

The outer sealing member 471 comes into contact with the coupling section 420 and one surface (specifically, upper surface) of the housing 200.

The outer sealing member 471 may be made of a rubber material having elasticity.

For example, the outer sealing member 471 is accommodated in the outer sealing groove 421.

Specifically, the outer sealing groove 421 is formed on the coupling section 420 so as to surround the insertion section 440 and the body coupling holes 427. That is, the outer sealing groove 421 defines a closed space (on the plane) in the circumferential direction of the coupling section 420.

In more detail, the outer sealing groove 421 is formed in such a manner that a partial region of the coupling section is recessed.

The outer sealing groove 421 preferably has a smaller size (height) than that of the outer sealing member 471 such that the outer sealing member 471 is sufficiently pressed.

That is, the outer sealing groove 421 has a ring shape so as to surround the body coupling holes 427.

In addition, the embodiment may further include an inner sealing member 473 (see FIG. 8C) for improvement of waterproof performance.

The inner sealing member 473 comes into contact with the coupling section 420 and one surface of the housing 200, and seals a region formed by the power connection hole 211 and the body coupling holes 427 in the coupling section 420.

Specifically, the inner sealing member 473 is arranged to be surrounded by the body coupling holes 427.

In more detail, the inner sealing member 473 has a ring shape surrounding the insertion section 440 and is disposed at the coupling section 420. The body coupling holes 427 are arranged to surround the inner sealing member 473 in the coupling section 420 and the outer sealing member 471 is arranged to surround the body coupling holes 427.

The inner sealing member 473 prevents water introduced through the body coupling holes 427 and the housing coupling holes 213 from infiltrating into the cable hole 430.

For example, the inner sealing member 473 may be accommodated in an inner sealing groove 425.

Specifically, the inner sealing groove 425 is formed so as to correspond to the inner sealing member 473.

That is, the inner sealing groove 425 is arranged so as to surround the insertion section 440 and is located so as to be surrounded by the body coupling hole 427. That is, the inner sealing groove 425 defines a closed space (on the plane) in the circumferential direction of the coupling section 420.

In more detail, the inner sealing groove 425 is formed in such a manner that a partial region of the coupling section 420 is recessed.

The inner sealing groove 425 preferably has a smaller size (height) than that of the inner sealing member 473 such that the inner sealing member 473 is sufficiently pressed.

The housing 200 has the power connection hole 211, the cable electrically connecting the power unit 100 to the light source module 600 passes through the housing 200, and the housing 200 defines a space in which the light source module 600 is located.

In addition, the housing 200 serves to dissipate heat.

Hereinafter, the housing 200 will be described in detail with reference to the drawings.

Figure 6:
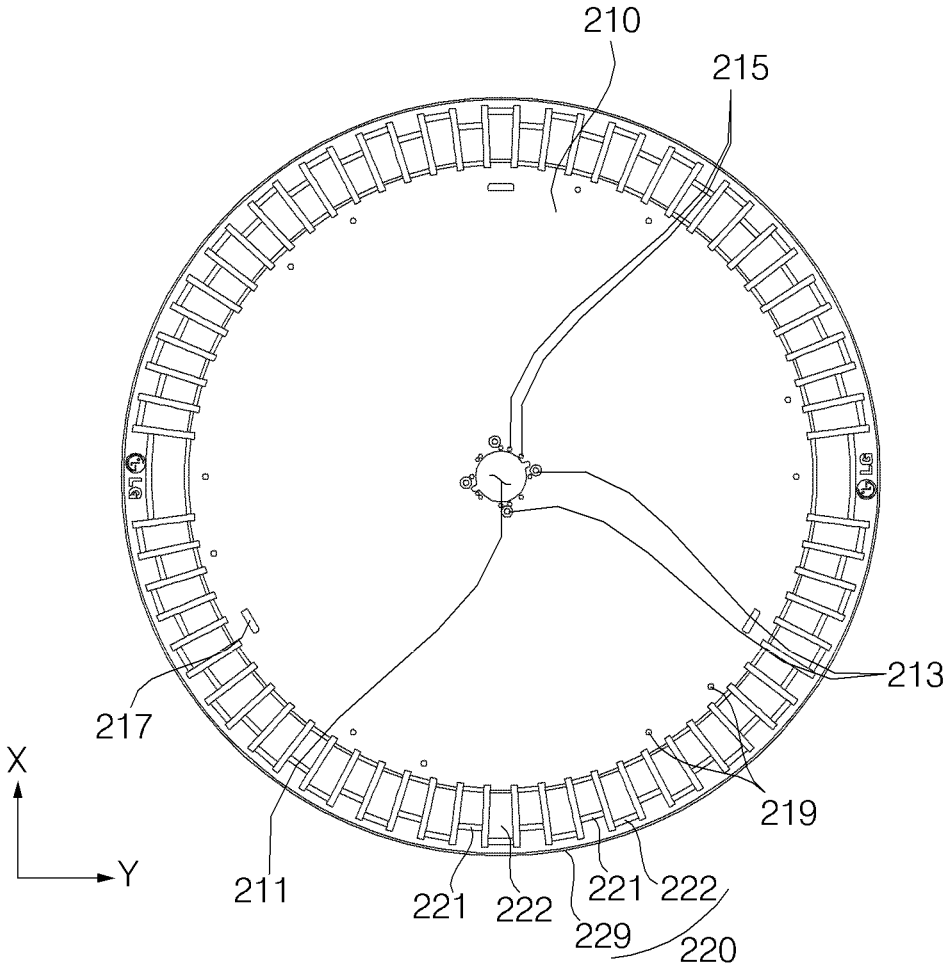
FIG. 6 is a top view illustrating a housing according to the embodiment of the present invention.
Figure 7A:
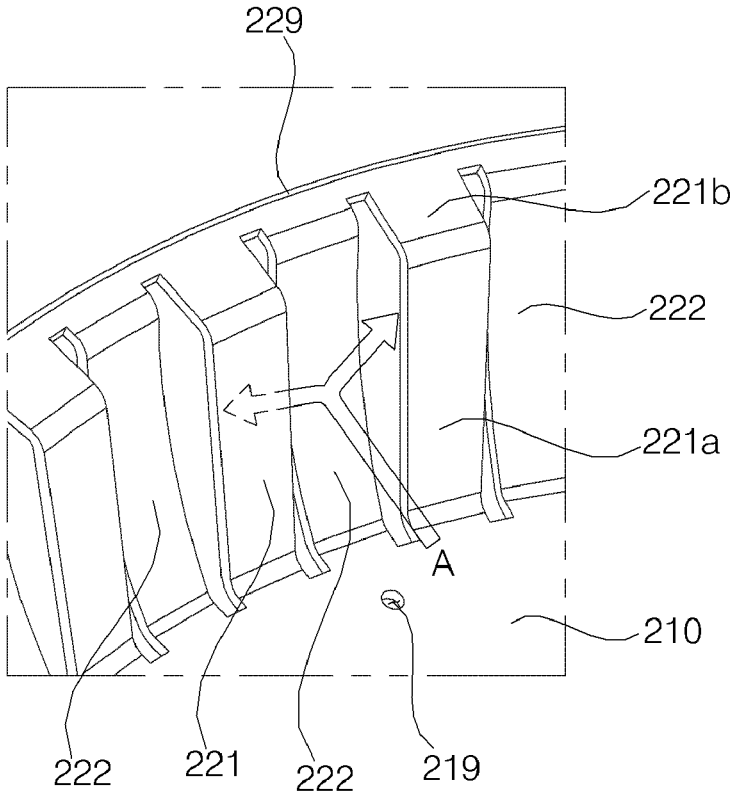
FIG. 7A is a perspective view illustrating a heat dissipation section of the housing.
Figure 7B:
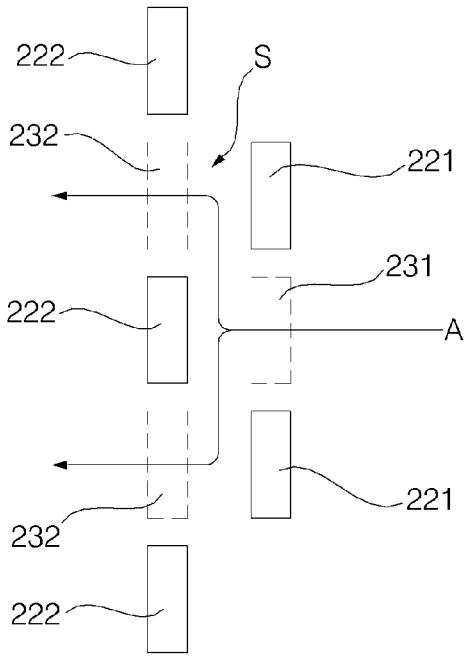
FIG. 7B is a cross-sectional view illustrating the heat dissipation section according to the embodiment of the present invention.

FIG. 6 is a top view illustrating the housing according to the embodiment of the present invention. FIG. 7A is a perspective view illustrating a heat dissipation section of the housing. FIG. 7B is a cross-sectional view illustrating the heat dissipation section according to the embodiment of the present invention.

Referring to FIGS. 6-7B, the housing 200 has the power connection hole 211 formed at the center thereof, and provides a space for coupling of the light source module 600 around the power connection hole 211.

For example, the housing 200 includes a base plate 210 and a heat dissipation section 220.

The base plate 210 and the heat dissipation section 220 are integrally formed, and each of them is made of a metal material such as aluminum having high conductivity.

In particular, the housing 200 may be made of a plate material for maximization of thermal conductivity.

The base plate 210 has the power connection hole 211 formed at the center thereof, and a space in which the light source module 600 is located is defined around the power connection hole 211.

Specifically, the base plate 210 may have a circular shape on the plane (X-Y axis plane).

The base plate 210 has a plurality of hook holes 217 circumferentially formed at an edge thereof.

A hook 520 (see FIG. 12) of the front cover 500 is fastened through each of the hook holes 217.

In particular, the hook hole 217 is arranged outside the light source module 600 on the plane.

In addition, the base plate 210 may have a plurality of bolt holes 219 circumferentially formed at the edge thereof. A bolt passing through the front cover 500 is coupled to each of the bolt holes 219.

Of course, the hook hole 217 and the bolt hole 219 are preferably located outside a region in which the light source module 600 is located in the base plate 210, for waterproofing.

A sealing ring 560 (see FIG. 12) is disposed inside the hook hole 217 and the bolt hole 219 so as to surround the light source module 600.

Since the hook hole 217 and the bolt hole 219 are located outside the sealing ring 560, water is prevented from being introduced into the light source module 600 from the outside.

Referring to FIGS. 6-7B, the heat dissipation section 220 dissipates heat transferred from the base plate 210.

The heat dissipation section 220 is arranged to surround the edge of the base plate 210, and includes first and second radiation fins 221 and 222 arranged in the circumferential direction of the housing 200.

A plurality of first radiation fins 221 is circumferentially arranged. Each second radiation fin 222 is located between the two adjacent first radiation fins 221.

Here, when natural convection occurs, outside air flows through a first radiation space 231 between each first radiation fin 221 and another first radiation fin 221 adjacent thereto, a space S between each first radiation fin 221 and each second radiation fin 222 associated therewith, and a second radiation space 232 between each second radiation fin 222 and another second radiation fin 222 adjacent thereto.

A residence time and a flow path A of outside air and a heat exchange area for convection are increased through the structure of the heat dissipation section 220 as described above.

Specifically, each first radiation space 231 may be arranged between the adjacent two first radiation fins 221 and each second radiation space 232 may be arranged between the adjacent two second radiation fins 222.

That is, the first radiation fins 221 may be respectively arranged so as to be spaced apart from each other by a predetermined distance in the circumferential direction of the housing 200, and the second radiation fins 222 may be respectively arranged so as to be spaced apart from each other by a predetermined distance in the circumferential direction of the housing 200.

Here, it is preferable that each of the first radiation spaces 231 is located to face the associated second radiation fin 222 and each of the second radiation spaces 232 is located to face the associated first radiation fin 221.

The outside air introduced into the first radiation spaces 231 collides with the second radiation fins 222, and thus the flow path A may be bent once. The outside air may flow to the space S between the first and second radiation fins 221 and 222 and then be discharged through the second radiation spaces 232 to the outside.

Meanwhile, the outside air may be branched into both sides in the space S between the first and second radiation fins 221 and 222.

Accordingly, the flow path A of the outside air may be changed when the outside air passes through the heat dissipation section 220, and particularly, the flow path A of the outside air may be bent twice or more when the outside air passes through the heat dissipation section 220. As such, a residence time of outside air and a heat exchange area for convection may be increased by complicatedly forming the flow path A.

Each of the first and second radiation fins 221 and 222 may extend from the base plate 210.

In particular, each of the first and second radiation fins 221 and 222 may extend from the base plate 210 so as to have a predetermined curvature, and the first and second radiation fins 221 and 222 may extend from the base plate 210 while having a different curvature.

In addition, the first and second radiation fins 221 and 222 may have a curvature so as to protrude in different directions. That is, the second radiation fin 222 may protrude toward the power unit 100 unlike the first radiation fin 221.

The first and second radiation fins 221 and 222 may form a plurality of holes by a certain pitch at the edge of the housing 200 made of a plate material in the circumferential direction of the housing 200, the holes defining the first and second radiation fins 221 and 222, and the first and second radiation fins 221 and 222 may be formed so as to protrude in different directions.

In addition, the heat dissipation section 220 is provided with a rim portion 229 connected to the first radiation fins 221 extending from the base plate 210 and the second radiation fins 222 extending from the base plate 210.

Specifically, the rim portion 229 forms an outer edge of the heat dissipation section 220 and is connected to outer ends of the first and second radiation fins 221 and 222.

The rim portion 229 maintains the shapes of the first and second radiation fins 221 and 222 and reinforces the stiffness of the housing 200.

In addition, the rim portion 229 may have improved stiffness through bending in one direction. Specifically, the rim portion 229 is bent toward the power unit 100.

Meanwhile, each of the first radiation fins 221 extends from the base plate 210 and may have a curved portion 221*a* having a predetermined curvature and a flat portion 221*b* bent from the curved portion 221*a*.

That is, the first radiation fin 221 may have a structure protruding in a direction opposite to the power unit 100 according to bending of the curved portion 221*a* and the flat portion 221*b*.

In addition, the flat portion 221*b* may be provided on the same plane as the rim portion 229 of the housing 200.

Each of the first and second radiation fins 221 and 222 may be made of a metal material having high thermal conductivity or a resin material.

For example, each of the first and second radiation fins 221 and 222 may be formed by perforating and bending one region in the housing 200 made of an aluminum plate material.

Meanwhile, each of the first and second radiation fins 221 and 222 may have a shape in which a width thereof is gradually enlarged as each extends away from the base plate 210.

In this case, the first and second radiation fins 221 and 222 may have the same width.

Referring to FIG. 3, the housing 200 may be coupled with a heat sink 300 for dissipating heat transferred from the housing.

For example, the heat sink 300 may have various shapes for increasing a contact area with outside air.

Specifically, the heat sink 300 is coupled to an upper surface of the base plate 210.

In more detail, the heat sink 300 has an opening 330 corresponding to the power connection hole 211 at the center thereof, and have a smaller width than the base plate 210.

In addition, the heat sink 300 includes a main plate 310 made of an aluminum plate material having high thermal conductivity and heat protrusions 320 protruding from the main plate 310.

In particular, the heat sink 300 has a coupling region 313 (see FIG. 2) through which a coupling member passes, and the coupling region 313 is located outside a region surrounded by a sealing ring 560 to be described later.

The power connection hole 211 provides a place in which the cable electrically connecting the power unit 100 and the light source module 600 passes.

That is, the power connection hole 211 is a space located at the center of the housing 200 so that a portion of the connection unit 400 is inserted and coupled to the power connection hole 211, and the cable passing through the inner portion of the connection unit 400 passes in the space.

In addition, a place for coupling of the light source module 600 and the connection unit 400 is provided around the power connection hole 211.

Accordingly, according to the embodiment, the power connection hole 211 and the periphery thereof are sealed, and thus a water leak is prevented from occurring due to the cable.

In addition, since the place for coupling of the light source module 600 and the connection unit 400 is provided around the power connection hole 211, a small region is sealed so that a water leak is easily prevented from occurring.

FIG. 8A is a top view illustrating the power connection hole formed in the housing according to the embodiment of the present invention. FIG. 8B is a top view illustrating a state in which the insertion section of the connection unit is inserted into the power connection hole according to the embodiment of the present invention. FIG. 8C is a cross-sectional view illustrating a state in which the insertion section of the connection unit is inserted into the power connection hole according to the embodiment of the present invention.

Referring to FIGS. 8A-8C, the power connection hole 211 is located at the center of the housing 200 when viewed from above.

Specifically, the power connection hole 211 is disposed at the center of the base plate 210 while having a shape corresponding to the base plate 210. The power connection hole 211 preferably has a circular shape.

In particular, the power connection hole 211 may have any size, but preferably has a smaller diameter or width than those of the power unit 100 and the housing 200 in consideration of heat transfer and waterproof performance between the power unit 100 and the light source module 600.

When the power connection hole 211 has a smaller size than the power unit 100 and the light source module 600, it may be possible to suppress heat of the power unit 100 from being transferred to the light source module 600 and to seal the power connection hole 211 at low cost.

Meanwhile, a place for coupling of the light source module 600 and the connection unit 400 is provided around the power connection hole 211. That is, the periphery of the power connection hole 211 is one region of the base plate 210 forming the edge of the power connection hole 211.

The alignment grooves 212 matched with the alignment protrusions 442 formed in the insertion section 440 may be formed around the power connection hole 211.

The alignment grooves 212 are matched with the alignment protrusions 442, thereby determining positions of the insertion section 440 and the power connection hole 211 at the time of temporary assembly.

Specifically, the alignment grooves 212 are formed by outwardly expanding a partial region of the power connection hole 211.

In addition, the embodiment further includes a positioning unit for determining positions of the housing 200 and the light source module 600.

Here, the positioning unit includes positioning holes 215 and 633 (see FIG. 10A) formed so as to correspond to the housing 200 and the light source module 600, respectively. The positioning holes 215 and 633 include a housing positioning hole 215 formed in the housing 200 and a light source positioning hole 633 formed in the light source module 600.

The light source positioning hole 633 is formed in the light source module 600 so as to correspond to the housing positioning hole 215, and description thereof will be given later.

A light source fastening member 820 (see FIG. 11) passing through a connector 699 to be described later may be coupled to the housing positioning hole 215.

For example, the housing positioning hole 215 is disposed around the power connection hole 211 so as to surround the power connection hole 211.

In particular, the positioning holes 215 and 633 are located to overlap with the inner sealing groove 425 formed in the coupling section 420 for waterproofing therebetween, and the inner sealing member 473 may seal the positioning holes 215 and 633.

For another example, a positioning unit may include a positioning hole formed in one of the housing 200 and the light source module 600 and a positioning protrusion (not shown) formed in the other of the housing 200 and the light source module 600 to be inserted into the positioning hole.

In addition, the base plate 210 has the housing coupling hole 213 located corresponding to the associated body coupling hole 427.

The housing fastening member 810 passes through the housing coupling hole 213.

Specifically, the housing coupling hole 213 includes a plurality of housing coupling holes formed in the circumferential direction of the power connection hole 211 so as to surround the power connection hole 211.

In more detail, the housing coupling holes 213 may be formed to be surrounded by the outer sealing member 471 in order to prevent water from being introduced from the outside, as illustrated in FIG. 8C.

That is, the housing coupling holes 213 are arranged around the power connection hole 211 when viewed from above, the outer sealing member 471 is located to surround the housing coupling holes 213, and the inner sealing member 473 is located between the power connection hole 211 and the housing coupling holes 213.

Figure 9:
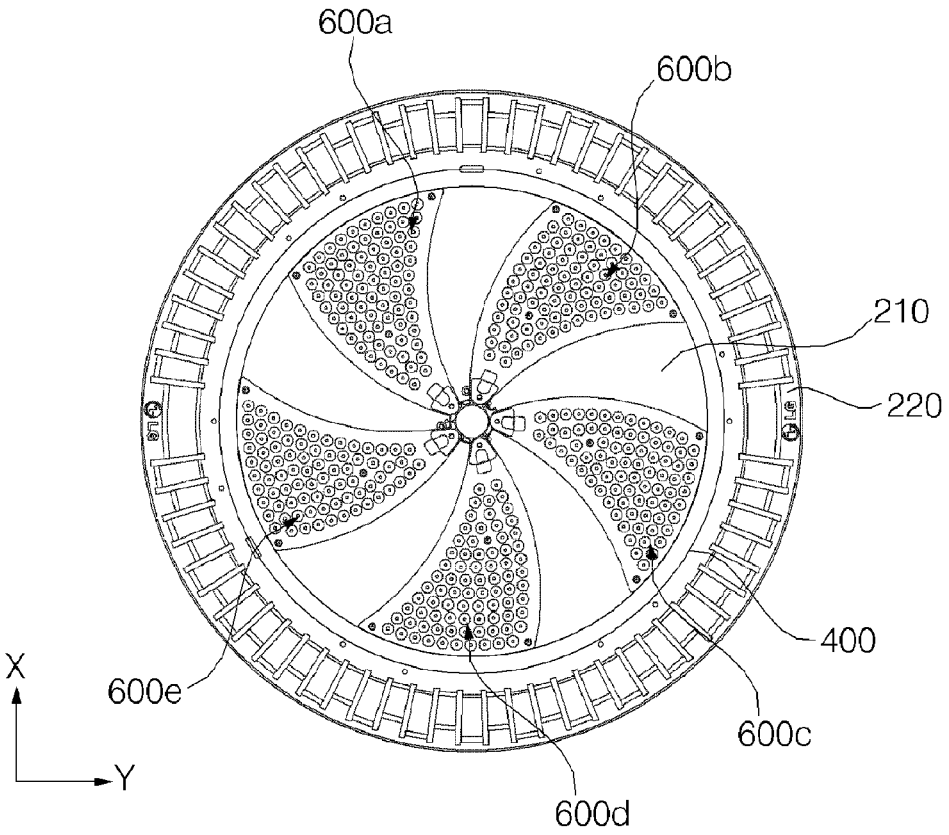
FIG. 9 is a top view illustrating a state in which light source modules are coupled to the housing according to the embodiment of the present invention.
Figure 10A:
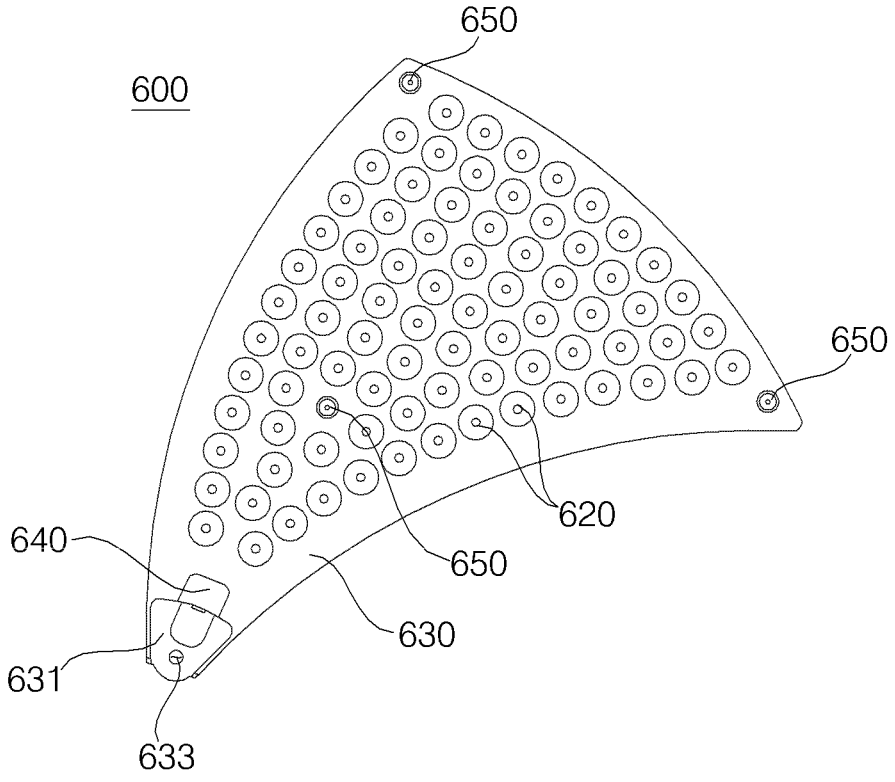
FIGS. 10A and 10B are perspective views illustrating one light source module when viewed from different directions according to the embodiment of the present invention.
Figure 10B:
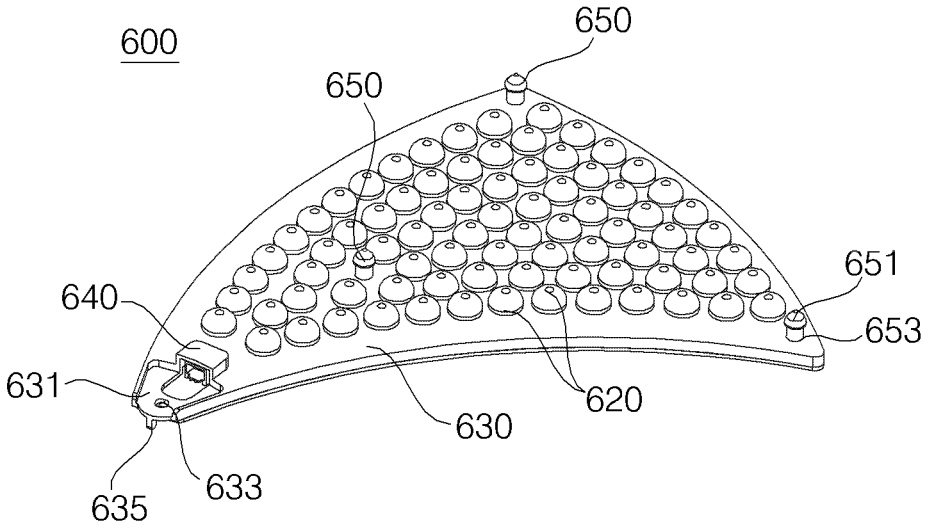
Figure 11:
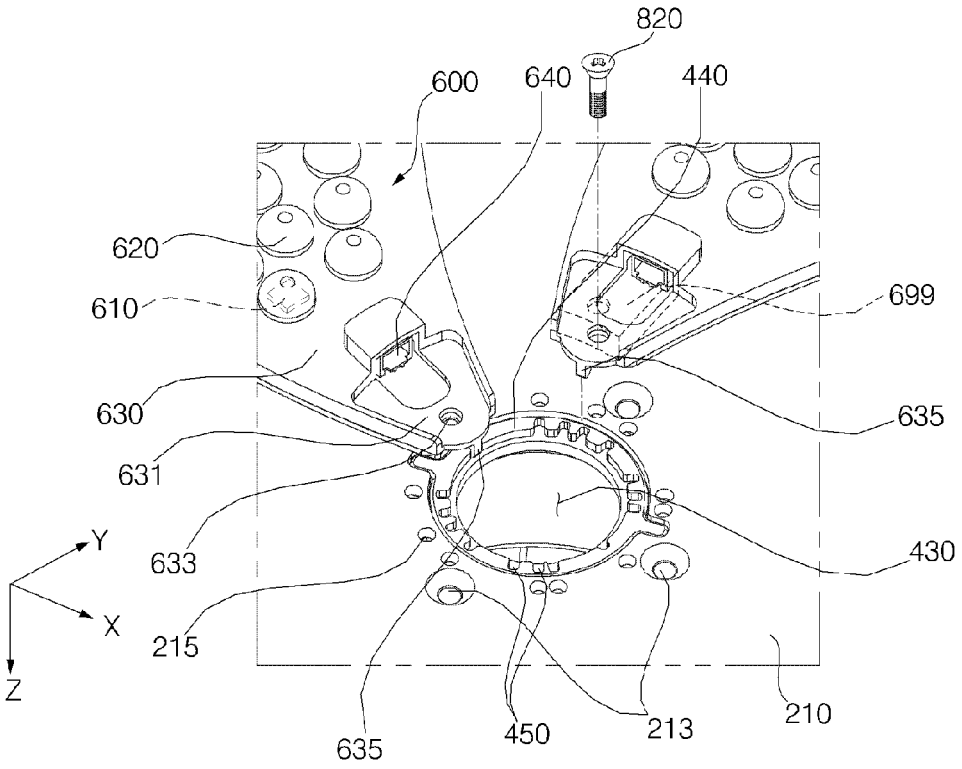
FIG. 11 is a reference view for explaining coupling between the light source modules and the housing according to the embodiment of the present invention.

FIG. 9 is a top view illustrating a state in which light source modules are coupled to the housing according to the embodiment of the present invention. FIGS. 10A and 10B are perspective views illustrating one light source module when viewed from different directions according to the embodiment of the present invention. FIG. 11 is a reference view for explaining coupling between the light source modules and the housing according to the embodiment of the present invention.

Referring to FIGS. 9 to 11, each light source module 600 may include all means for generating light.

For example, the light source module 600 may include a plurality of light emitting elements 610 and a support substrate 630 which supplies power to the light emitting elements 610 and supports the light emitting elements 610. However, the embodiment is not limited thereto, and a light emitting element package including the light emitting elements 610 may also be used as the light emitting elements 610.

Each of the light emitting elements 610 may be, for example, a light emitting diode. The light emitting diode may be a colored light emitting diode to emit, e.g., red, green, blue, and white light, or a UV (Ultra Violet) light emitting diode to emit ultraviolet light, but the embodiment is not limited thereto.

In addition, the light source module 600 may generate single color light and also emit white light by color mixture of light generated by the light emitting elements 610.

Each of the light emitting elements 610 may be covered by a lens 620 corresponding thereto.

The lens 620 changes optical properties of light generated by the light emitting element 610. Specifically, the lens 620 has a hemispherical shape and thus may expand an orientation angle of light generated by the light emitting element 610.

The support substrate 630 supplies power to the light emitting elements 610, and provides a space in which the light emitting elements 610 are located.

For example, the support substrate 630 includes a printed circuit board.

The support substrate 630 has any shape, but may have a shape in which a width thereof is gradually enlarged from one end of the support substrate 630 toward the other end thereof since one end of the light source module 600 has to be adjacent to the power connection hole 211.

In addition, the light source module 600 includes support protrusions 650, a connector coupling section 640, and a connector seating groove 631.

The support protrusions 650 are pressed by the front cover 500 to fix the light source module 600 in a space defined by the housing 200 and the front cover 500.

The support protrusions 650 are supported by the front cover 500 and are pressed when the front cover 500 is coupled to the housing 200.

Accordingly, when the support protrusions 650 are used, a separate fastening member is unnecessary when the light source module 600 is coupled to the housing 200 and water introduction caused by coupling of the fastening member is prevented.

For example, the support protrusions 650 protrude from the support substrate 630.

Specifically, the support protrudes 650 are formed so as to protrude further than the light emitting elements 610 (and the lenses 620) from the support substrate 630. Thereby, the light emitting elements 610 are not pressed when the front cover 500 presses the support protrusions 650.

Figure 12:
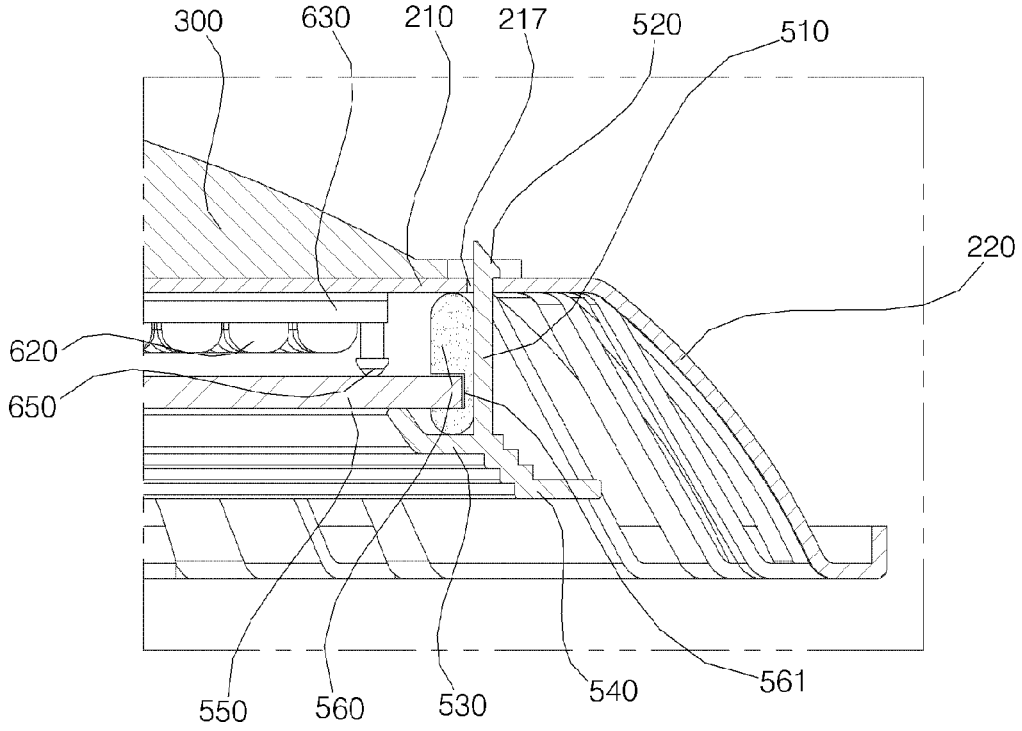
FIG. 12 is a cross-sectional view for explaining coupling of a front cover according to the embodiment of the present invention.

In more detail, the support protrusions 650 may be pressed by an optical plate 550 as shown in FIG. 12, and description thereof will be given later.

The support protrusions 650 may be elastically deformed. Specifically, each of the support protrusions 650 may include a support member 653 protruding from the support substrate 630 and an elastic member 651 which is connected to the support member 653 and is made of a material having more elasticity than the support member 653.

The connector coupling section 640 is coupled with the connector 699 connected to the cable.

The connector coupling section 640 is located at one end of the support substrate 630. Here, one end of the support substrate 630 has a small width and thus is arranged adjacent to the power connection hole 211.

In addition, the support substrate 630 includes the connector seating groove 631 to which the connector 699 is seated. In this case, the connector seating groove 631 is formed to correspond to a position of the connector 699, and may be formed by recessing the support substrate 630.

The light source positioning hole 633 may be formed in the connector seating groove 631. The light source fastening member 820 passing through the connector 699 passes through the light source positioning hole 633.

In addition, the light source module 600 further includes the light source fixing protrusion 635 matched with the light source fixing groove 450.

The light source fixing protrusion 635 is matched with the light source fixing groove 450 and fixes the light source module 600.

The light source fixing protrusion 635 protrudes from the support substrate 630.

Specifically, the light source fixing protrusion 635 protrudes from a surface opposite to the surface on which the light emitting elements 610 are disposed in the support substrate 630.

In addition, the light source fixing protrusion 635 is located at one end of the support substrate 630. Here, one end of the support substrate 630 is disposed adjacent to the power connection hole 211 and is a region having a smaller width than the other end of the support substrate 630.

In this case, one end of the light source module 600 overlaps with the power connection hole 211, and the light source fixing protrusion 635 is located in a region overlapping with the power connection hole 211 in the light source module 600.

The light source fixing protrusion 635 has any shape, but preferably has a shape formed so as not to move in the light source fixing groove 450 when the light source fixing protrusion 635 is fitted to the light source fixing groove 450.

The light source module 600 is disposed on the lower surface of the housing 200.

Specifically, the light source module 600 is disposed on the lower surface of the base plate 210.

In this case, the light source module 600 has a width gradually enlarged proceeding in a direction away from the power connection hole 211. That is, the width of the light source module 600 is gradually enlarged from one end of the light source module 600 (specifically, one end of the support substrate 630) toward the other end thereof. One end of the light source module 600 is disposed adjacent to the power connection hole 211.

Accordingly, the power connection hole 211 is surrounded by shapes of a plurality of light source modules 600, and the number of required light source modules 600 may be provided in the lighting device 10.

The light source modules 600 are radially arranged about the power connection hole 211 as a whole, as illustrated in FIG. 9.

Since the width of each light source module 600 is gradually enlarged from one end toward the other end, a plurality of light source modules 600 may be connected about the power connection hole 211. Thus, since only the periphery of the power connection hole 211 is sealed, a waterproof structure may be easily formed.

In addition, the power connection hole 211 and one end of each light source module 600 are covered by a cap 800 (see FIG. 3).

The cap 800 is inserted and coupled to the power connection hole 211.

Figure 13:
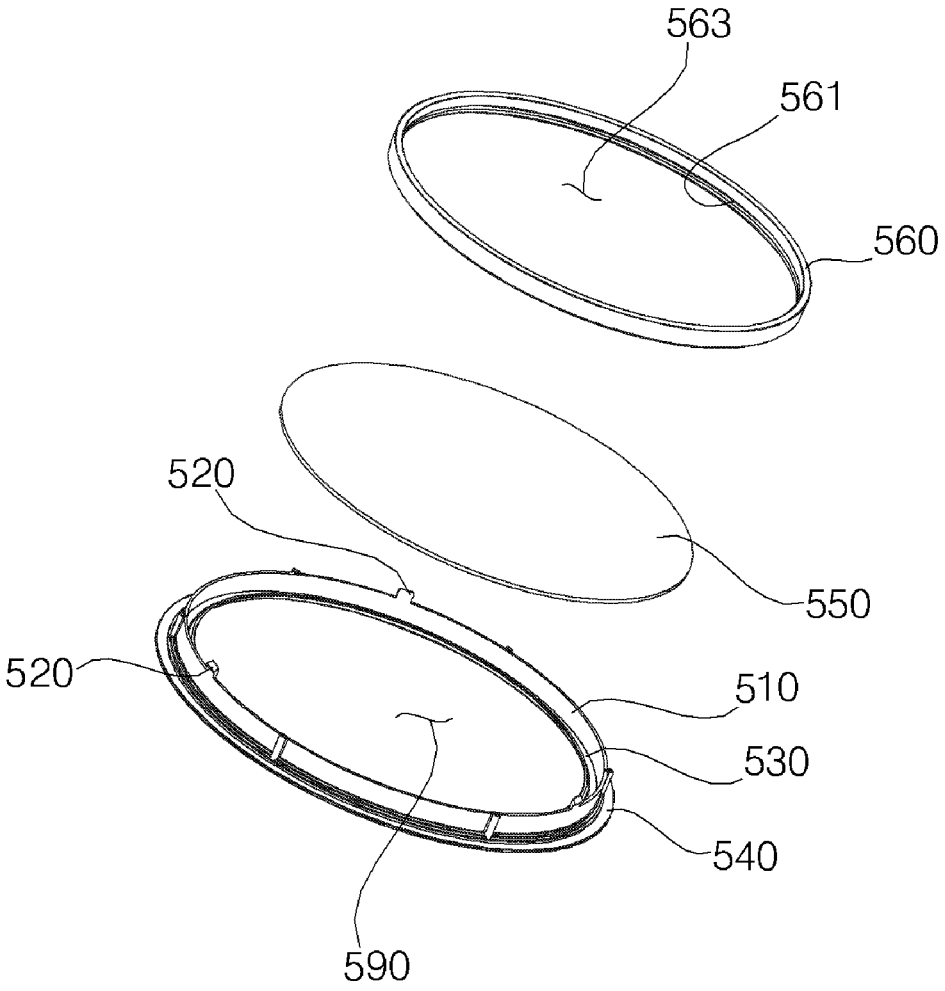
FIG. 13 is an exploded perspective view illustrating the front cover according to the embodiment of the present invention.

FIG. 12 is a cross-sectional view for explaining coupling of the front cover according to the embodiment of the present invention. FIG. 13 is an exploded perspective view illustrating the front cover according to the embodiment of the present invention.

Referring to FIGS. 12 and 13, the front cover 500 is coupled to the housing 200 and defines a space in which each light source module 600 is located. The front cover 500 transmits light generated by the light source module 600.

In addition, the front cover 500 presses the support protrusions 650 of the light source module 600 when being coupled to the housing 200, with the consequence that the light source module 600 is fastened without a fastening member.

For example, the front cover 500 is integrally formed and may have a sealing structure between a region in which the light source module 600 is located and the outside when the front cover 500 is coupled to the housing 200.

For another example, a front cover 500 may be configured of a plurality of components.

Specifically, the front cover 500 covers the base plate 210 and the lower portion of the light source module 600.

The front cover 500 includes a cover body 510, a front cover coupling member, and an optical plate 550.

The cover body 510 is formed to surround the light source module 600 and the power connection hole 211.

Specifically, the cover body 510 is disposed to surround the power connection hole 211 when viewed from below, and a space in which the light source module 600 is located is defined between the cover body 510 and the power connection hole 211.

In more detail, the cover body 510 has a ring shape. In addition, the cover body 510 has an expansion section 540 formed at a lower portion thereof to be expanded outward.

The expansion section 540 guides light generated by the light source module 600.

In addition, the front cover 500 further includes a sealing ring seating section 530 to which the sealing ring 560 (or the optical plate 550) to be described later is seated.

The sealing ring 560 is seated to the sealing ring seating section 530.

Specifically, the sealing ring seating section 530 extends inward from the cover body 510. That is, the sealing ring seating section 530 has a ring shape extending inward from the cover body 510.

In addition, the sealing ring seating section 530 has an end bent upward so as to prevent the seated sealing ring 560 from being decoupled therefrom.

The front cover coupling member couples the cover body 510 to the housing 200.

For example, the front cover coupling member includes a hook 520 which is coupled through the hook hole 217 formed in the housing 200. The hook 520 may include a plurality of hooks arranged in a circumferential direction of the cover body 510.

Specifically, the hooks 520 protrude upward from the cover body 510.

For another example, a front cover coupling member may be a bolt (not shown) which is fastened through the housing 200 and the cover body 510.

The optical plate 550 covers the lower portion of the light source module 600 and changes optical properties of the light source module 600.

In addition, the optical plate 550 covers the lower portion of the light source module 600 to protect the light source module 600 from the outside.

For example, the optical plate 550 may diffuse light incident on the light source module 600 as surface light.

The optical plate 550 has scattered particles therein for scattering light incident on the light source module 600, and may convert point light incident on the light source module 600 into surface light.

In accordance with the embodiment, the optical plate 550 may be used by manufacturing PMMA (polymethylmethacrylate) or transparent acrylic resin as a flat or wedge type, and may be made of a glass material. In addition, the optical plate 550 may be a plastic material, but the embodiment is not limited thereto.

Specifically, the optical plate 550 may have a plate or film shape.

Preferably, the optical plate 550 may be made of a synthetic resin material having certain stiffness and ductility and high processability.

In addition, the optical plate 550 is formed so as to correspond to the shape and size of a region in which the light source module 600 is located. That is, the optical plate 550 may have a shape fitted inside the cover body 510.

The optical plate 550 presses the support protrusions 650 when the front cover 500 is coupled to the housing 200.

In order to prevent water or foreign substances from being introduced into the light source module 600 from the outside, the front cover 500 may further include the sealing ring 560.

The sealing ring 560 seals between a space in which the light source module 600 is located and the outside. Specifically, the sealing ring 560 seals between the space defined by the cover body 510 in the lower surface of the base plate 210 and the outside.

In addition, the sealing ring 560 is coupled to the optical plate 550 to seal between the inner portion and the outer portion of the optical plate 550.

Specifically, the sealing ring 560 has a ring shape so as to be seated to the sealing ring seating groove 530.

The edge of the optical plate 550 is fitted to the sealing ring 560 in the internal space. For example, an inner surface of the sealing ring 560 is recessed outward so that a ring groove 561 is formed, and the edge of the optical plate 550 is fitted to the ring groove 561.

Accordingly, the region of the base plate 210 in which the light source module 600 is located may be sealed from the outside by the sealing ring 560.

In this case, the front cover coupling member is located outside a closed space defined by the sealing ring 560, and thus water or the like introduced from the front cover coupling member is further prevented from infiltrating into the light source module 600.

Figure 10C:
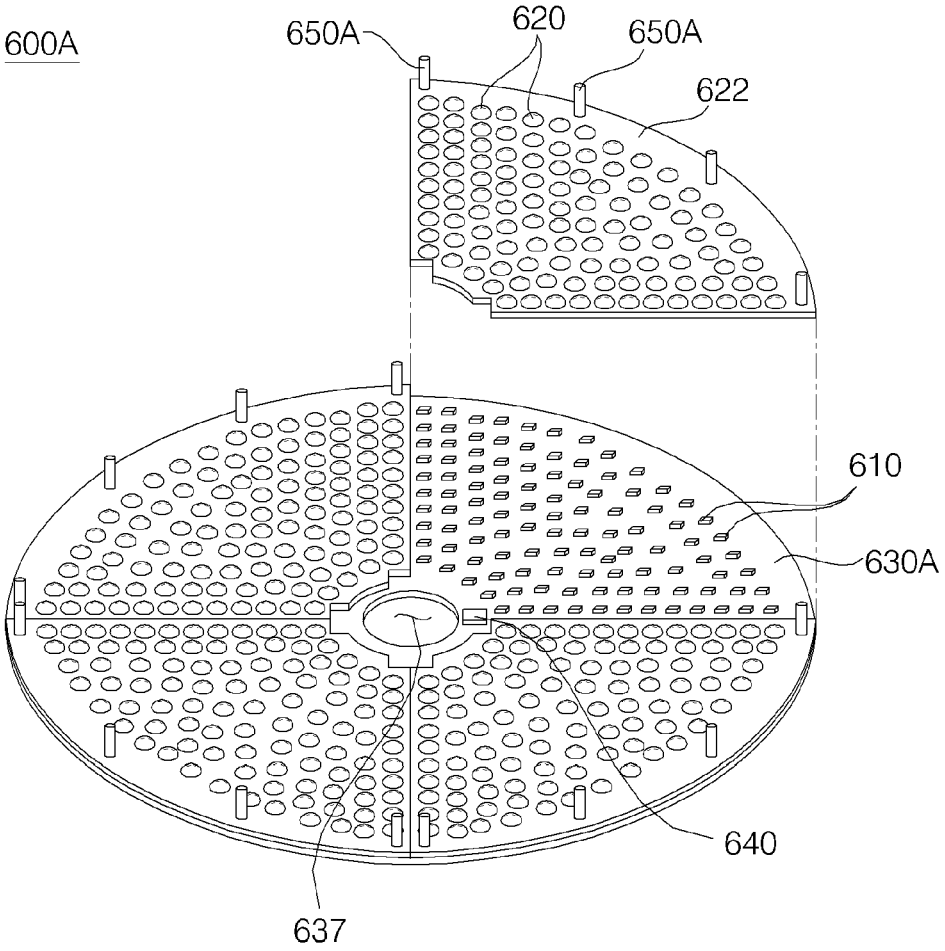
FIG. 10C is a perspective view illustrating a light source module according to another embodiment of the present invention.
Figure 10D:
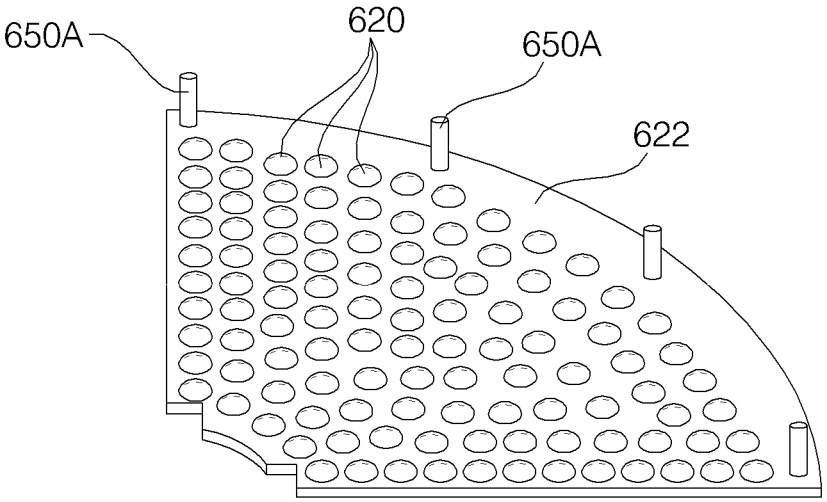
FIG. 10D is a perspective view illustrating a lens array according to another embodiment of the present invention.
Figure 10E:
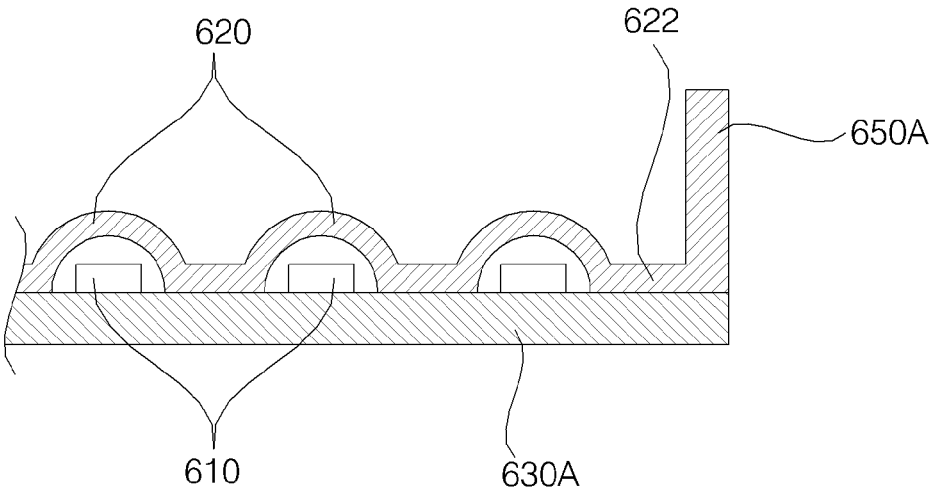
FIG. 10E is a cross-sectional view illustrating a portion of the light source module illustrated in FIG. 10C.

FIG. 10C is a perspective view illustrating a light source module according to another embodiment of the present invention. FIG. 10D is a perspective view illustrating a lens array according to another embodiment of the present invention. FIG. 10E is a cross-sectional view illustrating a portion of the light source module illustrated in FIG. 10C.

Referring to FIGS. 10C to 10E, a light source module 600A according to another embodiment differs from that of the embodiment illustrated in FIG. 10A, in terms of a lens array having a plurality of lenses 620, a shape of a support substrate 630A, and a position of a support protrusion 650A.

The support substrate 630A has a hole 637, which is formed at a center thereof and corresponds to the power connection hole 211, and has a shape corresponding to the base plate 210. Specifically, the support substrate 630A has a circular shape when viewed from below. The support substrate 630A is provided with a plurality of light emitting elements 610.

The lens array has a structure in which the lenses 620 are coupled to each other. The lens array serves to fix positions of the lenses 620 corresponding to the light emitting elements 610. For example, the lens array includes a plurality of lenses 620 and a support plate 622 on which the lenses 620 are located.

Here, the support plate 622 has any shape, but may have a shape corresponding to the shape of the support substrate 630A. The support plate 622 includes a plurality of support plates arranged to cover the support substrate 630A. For example, each of the support plates 622 has a quarter-circular shape. The support plate 622 is made of the same material as that of each lens 620.

The lenses 620 arranged on the support plates 622 are located corresponding to the light emitting elements 610.

In this case, the support protrusion 650A may be formed at each support plate 622. The support protrusion 650A protrudes from the support plate 622.

Figure 14A:
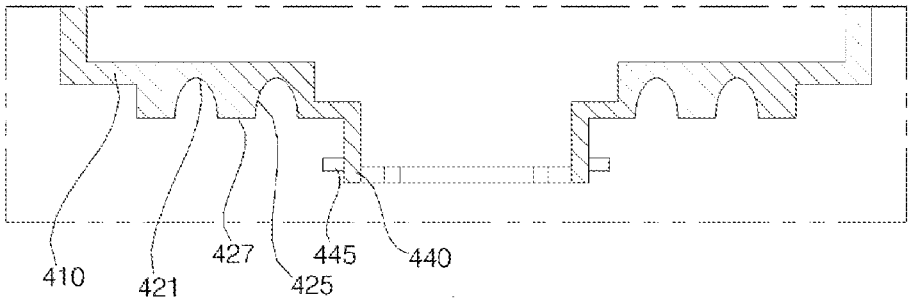
FIG. 14A is a cross-sectional view illustrating a connection unit according to another embodiment of the present invention.
Figure 14B:
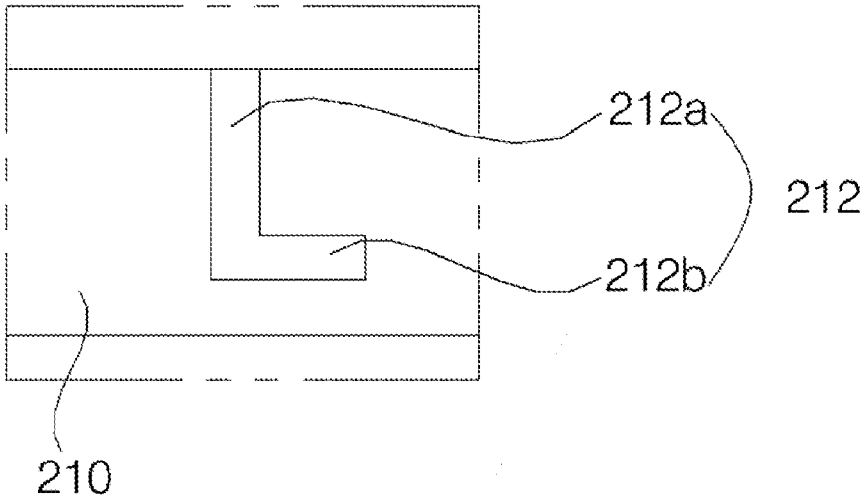
FIG. 14B is a view illustrating an inner surface of a power connection hole according to another embodiment of the present invention.

FIG. 14A is a cross-sectional view illustrating a connection unit according to another embodiment of the present invention. FIG. 14B is a view illustrating an inner surface of a power connection hole according to another embodiment of the present invention.

A lighting device according to another embodiment further includes a fastening guide, compared to the lighting device 10 of the above embodiment.

Referring to FIGS. 14A-14B, the fastening guide guides the coupling between the connection unit 400 and the housing 200.

That is, the fastening guide guides the connection unit 400 and the housing 200 when they are coupled to each other, so that the connection unit 400 and the housing 200 are temporarily assembled to each other.

For example, the fastening guide includes a guide groove 212 and a guide protrusion 445.

The guide groove is formed at one of the power connection hole 211 and the connection body 410 and the guide protrusion is formed at the other of the power connection hole 211 and the connection body 410.

FIG. 14B illustrates that the guide groove 212 is formed at the power connection hole 211 and FIG. 14A illustrates that the guide protrusion 445 is formed at the connection body 410, but the embodiment is not limited thereto.

A guide place is provided by matching of the guide groove 212 and the guide protrusion 445.

Specifically, the guide groove 212 is formed in such a manner that the inner surface of the power connection hole 211 is recessed outward.

The guide groove 212 is opened at an upper portion thereof, and includes a first guide groove 212*a* to which the guide protrusion 445 slides from top to bottom and is coupled, and a second guide groove 212*b* to which the guide protrusion 445 sliding in the first guide groove 212*a* laterally slides and is coupled.

The first guide groove 212*a* is opened at an upper portion thereof and is vertically elongated. That is, the first guide groove 212*a* guides vertical movement of the connection body 410.

The second guide grove 212*b* communicates with the first guide groove 212*a* and is formed perpendicular to the first guide groove 212*a*, so as to guide lateral movement (rotation) of the guide protrusion 445.

That is, vertical movement of the guide protrusion 445 is restricted by the second guide groove 212*b*. Thus, the vertical movement is restricted when the housing 200 is temporarily assembled to the connection body 410.

For another example, a guide groove (not shown) may be formed in such a manner that the outer surface of the insertion section 440 is recessed inward.

The guide groove in another example may include a first guide groove (not shown) to which the guide protrusion 445 slides from bottom to top and is coupled, and a second guide groove (not shown) to which the guide protrusion 445 sliding in the first guide groove laterally slides and is coupled.

The guide protrusion 445 is formed at the connection body 410 to be guided by the guide groove 212. For another example, a guide protrusion (not shown) may protrude from the inner surface of the power connection hole 211.

Specifically, the guide protrusion 445 protrudes outward from the outer surface of the insertion section 440, and is guided by the guide groove 212 when the insertion section 440 is inserted into the power connection hole 211.

Thus, when the insertion section 440 is inserted into the power connection hole 211, the insertion section 440 is inserted from top to bottom by the fastening guide and is then fixed by rotation in one direction.

Figure 15A:
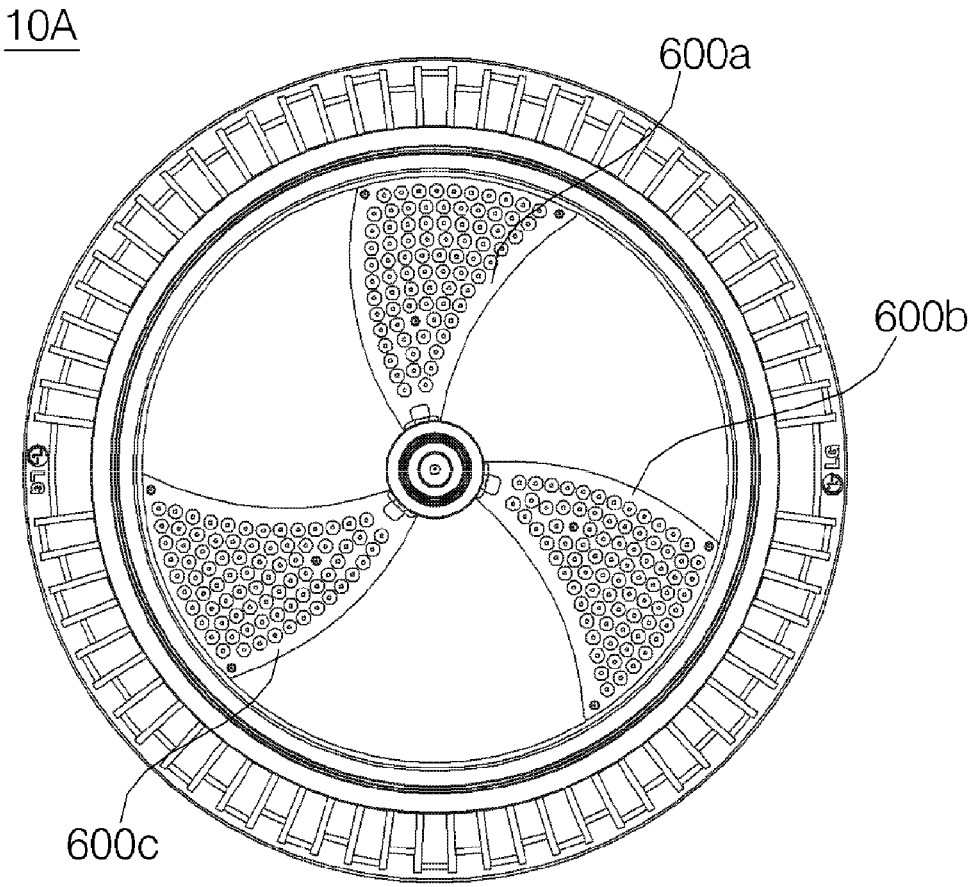
FIGS. 15A to 15C are top views illustrating a lighting device according to further embodiments of the present invention.
Figure 15B:
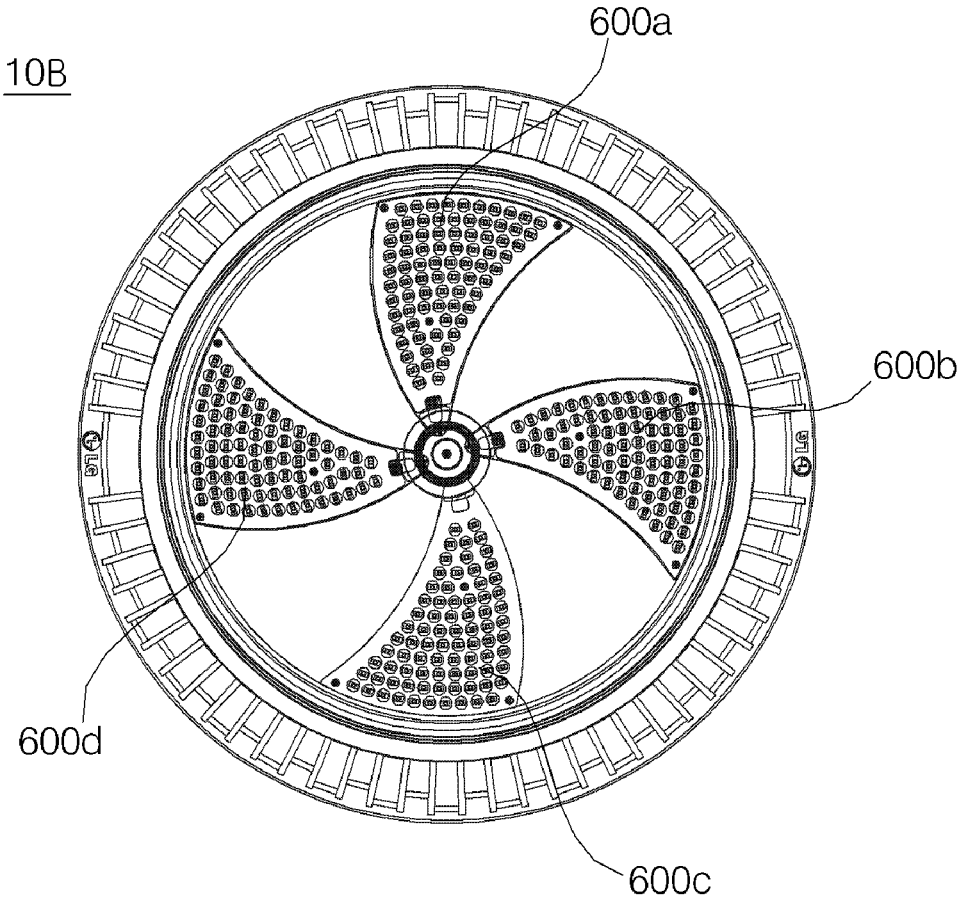
Figure 15C:
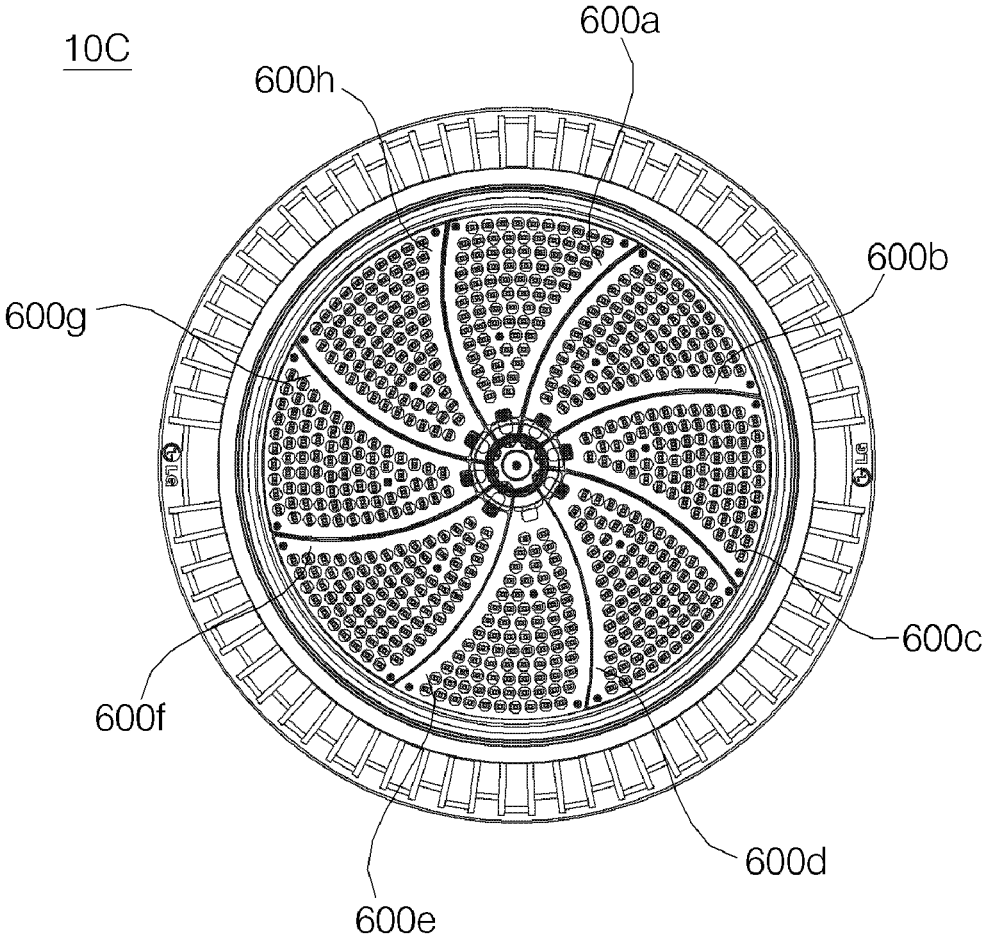

FIGS. 15A to 15C are top views illustrating a lighting device according to further embodiments of the present invention.

The embodiments in FIGS. 15A to 15C differ from the embodiment illustrated in FIG. 9 in terms of the number of light source modules.

FIGS. 15A to 15C illustrate a structure in which various numbers of light source modules are connected about a power connection hole 211 in a lighting device.

FIG. 15A illustrates three light source modules 600*a* to 600*c* arranged about the power connection hole 211 in a lighting device 10A.

In this case, an internal angle between the light source modules 600 may be an angle of 120° in order to emit uniform light in the lighting device 10.

FIG. 15B illustrates four light source modules 600.

In a lighting device 10B of FIG. 15B, four light source modules 600*a* to 600*d* are arranged about the power connection hole 211.

In this case, an internal angle between the light source modules 600 may be an angle of 90° in order to emit uniform light in the lighting device 10.

FIG. 15C illustrates eight light source modules 600.

In a lighting device 10C of FIG. 15C, eight light source modules 600*a* to 600*h* are arranged about the power connection hole 211.

In this case, an internal angle between the light source modules 600 may be an angle of 45° in order to emit uniform light in the lighting device 10.

As described above, the lighting device 10 according to the embodiments may easily realize lighting in various forms of power consumption by changing the number of light source modules. In addition, since the lighting device has a structure in which the light source module 600 is coupled to the power connection hole 211 even though various numbers of light source modules are present, the sealing structure may be easily formed. Furthermore, since the cable is connected through the power connection hole 211, it may be possible to simply supply power to the light source module 600.

In accordance with the embodiments of the present invention, lighting in a desired form of power consumption may be easily realized by changing the number of light source modules coupled to the housing.

In addition, since the housing provided with the light source module is connected to the power unit using the connection unit in a spaced state, heat generated by the power unit may be suppressed from being transferred to the light source modules.

In addition, since power of the power unit is supplied to the light source module by the cable through the cable hole of the connection unit and the connector coupling section of the light source module is arranged adjacent to the power connection hole, power supply between the power unit and the light source module may be easily performed.

In addition, since the lighting device has a structure in which the light source module is coupled to the light source fixing groove formed on the inner surface of the power connection hole even though various numbers of light source modules are present, a large number of light source modules may be easily connected to the power connection hole and the sealing structure may be easily formed.

In addition, since the place for coupling of the power unit and the light source module is located around the power connection hole, the small region may be sealed so that a water leak is easily prevented from occurring.

In addition, since the lighting device has a structure in which the front cover presses the support protrusions protruding from the support substrate, a separate fastening member may be unnecessary when the light source module is coupled to the housing and water introduction caused by coupling of the fastening member may be prevented.

In addition, since the lighting device has the heat dissipation section for increasing a contact time between the housing and air, heat transferred to the housing may be efficiently dissipated.

In addition, it may be possible to prevent movement when the insertion section of the connection unit is fastened to the power connection hole, using the fastening guide.

As is apparent from the above description, in a lighting device according to exemplary embodiments of the present invention, lighting in a desired form of power consumption may be easily realized by changing the number of light source modules coupled to a housing.

In addition, since the housing provided with the light source module is connected to a power unit using a connection unit in a spaced state, heat generated by the power unit may be suppressed from being transferred to the light source module.

In addition, since power of the power unit is supplied to the light source module by a cable through a cable hole of the connection unit and a connector coupling section of the light source module is arranged adjacent to the power connection hole, power supply between the power unit and the light source module may be easily performed.

In addition, since the lighting device has a structure in which the light source module is coupled to a light source fixing groove formed on an inner surface of the power connection hole even though various numbers of light source modules are present, a large number of light source modules may be easily connected to the power connection hole and a sealing structure may be easily formed.

In addition, since a place for coupling of the power unit and the light source module is located around the power connection hole, a small region may be sealed so that a water leak is easily prevented from occurring.

In addition, since the lighting device has a structure in which a front cover presses a support protrusion protruding from a support substrate, a separate fastening member may be unnecessary when the light source module is coupled to the housing and water introduction caused by coupling of the fastening member may be prevented.

In addition, since the lighting device has a heat dissipation section for increasing a contact time between the housing and air, heat transferred to the housing may be efficiently dissipated.

In addition, it may be possible to prevent movement when an insertion section of the connection unit is fastened to the power connection hole, using a fastening guide.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lighting device comprising:

a housing having a power connection hole therein;

at least one light source module disposed at a lower surface of the housing, the light source module including a support protrusion;

a front cover coupled to the housing to define a space in which the light source module is located, the front cover configured to permit light generated by the light source module to pass therethrough;

a power unit spaced apart from the housing, the power unit configured to supply power to the light source module;

a connection unit connecting the housing to the power unit, the connection unit including:

a cable hole through which a cable is configured to pass; and a connection body surrounding the cable hole; and a light source fixing unit to fix the light source module to the connection unit, the light source fixing unit including:

at least one light source fixing groove provided on the connection body and recessed in a direction extending outwardly of the cable hole; and a light source fixing protrusion provided on the light source module and receivable within the light source fixing groove, wherein the front cover presses against the support protrusion when the front cover is coupled to the housing to support the light source module, and wherein a portion of the connection body is inserted into the power connection hole in the housing.

2. The lighting device according to claim 1, wherein the front cover comprises:

a cover body surrounding the light source module;

a front cover coupling member coupling the cover body to the housing; and an optical plate covering a lower portion of the light source module, the optical plate configured to change optical properties of light generated by the light source module.

3. The lighting device according to claim 2, further comprising a hook hole provided in the housing, wherein the front cover coupling member comprises a hook coupled through the hook hole in the housing.

4. The lighting device according to claim 2, wherein the cover body includes an expansion section at a lower portion of the cover body and extending outwardly from the cover body, the expansion section configured to guide light generated by the light source module.

5. A lighting device comprising:

a housing having a power connection hole therein;

at least one light source module disposed at a lower surface of the housing, the light source module including a support protrusion; and a front cover coupled to the housing to define a space in which the light source module is located, the front cover configured to permit light generated by the light source module to pass therethrough, wherein the front cover presses against the support protrusion when the front cover is coupled to the housing to support the light source module, and wherein the front cover comprises:

a cover body surrounding the light source module;

a front cover coupling member coupling the cover body to the housing;

an optical plate covering a lower portion of the light source module, the optical plate configured to change optical properties of light generated by the light source module;

a sealing ring to which an edge of the optical plate is fitted, the sealing ring being located inwardly of the cover body; and a sealing ring seating section for seating the sealing ring on the front cover.

6. The lighting device according to claim 5, wherein the front cover coupling member is located outside of a closed space defined by the sealing ring.

7. The lighting device according to claim 5, wherein the light source module comprises:

a support substrate; and a plurality of light emitting elements protruding from the support substrate, wherein the support protrusion protrudes further from the support substrate than the light emitting elements.

8. The lighting device according to claim 7, wherein the support protrusion is pressed by the optical plate.

9. The lighting device according to claim 1, wherein the connection body comprises:

an insertion section inserted into the power connection hole in the housing; and a coupling section overlapping with a periphery of the power connection hole, wherein the light source fixing groove is provided in the insertion section.

10. The lighting device according to claim 9, wherein the light source fixing groove comprises a plurality of light source fixing grooves circumferentially arranged on an inner surface of the cable hole.

11. The lighting device according to claim 10, wherein one end of the light source module overlaps with a portion of the power connection hole in the housing, and wherein the light source fixing protrusion is located at the one end of the light source module overlapping with the portion of the power connection hole.

12. The lighting device according to claim 9, wherein the light source module comprises:

a plurality of light emitting elements; and a support substrate supporting the light emitting elements, wherein the support substrate comprises:

a connector coupling section coupled with a connector connectable to a cable; and a connector seating groove into which the connector is seated.

13. The lighting device according to claim 12, further comprising a positioning unit including:

a housing positioning hole provided in the housing; and a light source positioning hole provided in the light source module.

14. A lighting device comprising:

a housing having a power connection hole therein;

at least one light source module disposed at a lower surface of the housing, the light source module including a support protrusion;

a front cover coupled to the housing to define a space in which the light source module is located, the front cover configured to permit light generated by the light source module to pass therethrough, wherein the front cover presses against the support protrusion when the front cover is coupled to the housing to support the light source module;

a power unit spaced apart from the housing, the power unit configured to supply power to the light source module; and a connection unit connecting the housing to the power unit, the connection unit including:

a cable hole through which a cable is configured to pass; and a connection body surrounding the cable hole, wherein a portion of the connection body is inserted into the power connection hole in the housing, and wherein the connection body comprises:

an insertion section inserted into the power connection hole in the housing;

a coupling section overlapping with a periphery of the power connection hole to come into contact with a rear surface of the housing;

at least one body coupling hole provided in the coupling section; and a housing fastening member passing through the housing and coupled to the body coupling hole.

15. The lighting device according to claim 14, wherein the lighting device further comprises a sealing member located between the coupling section and the rear surface of the housing.

16. The lighting device according to claim 15, wherein the sealing member is arranged to surround the insertion section and the body coupling hole.

17. The lighting device according to claim 15, wherein the sealing member comprises:

an inner sealing member arranged to surround the insertion section; and an outer sealing member arranged to surround the insertion section, the inner sealing member, and the body coupling hole.

18. The lighting device according to claim 17, wherein the coupling section of the connection body further comprises an outer sealing groove surrounding the insertion section and the body coupling hole, and wherein the outer sealing member is inserted into the outer sealing groove.

* * * * *